US005615178A

United States Patent [19]

Takakura et al.

[11] Patent Number: 5,615,178

[45] Date of Patent: Mar. 25, 1997

[54] ELECTRONIC CONTROL TIMEPIECE

[75] Inventors: Akira Takakura, Chiba; Osamu Takahashi, Suwa, both of Japan

[73] Assignees: Seiko Instruments Inc.; Seiko Epson Corporation, both of Japan

[21] Appl. No.: 591,987

[22] Filed: Jan. 29, 1996

Related U.S. Application Data

[63] Continuation of Ser. No. 510,424, Aug. 2, 1995, abandoned.

[30] Foreign Application Priority Data

Aug. 3, 1994 [JP] Japan ..... 6-182617
Jun. 22, 1995 [JP] Japan ..... 7-156546

[51] Int. Cl.[6] ..... G04B 1/00

[52] U.S. Cl. ..... 368/203; 368/204

[58] Field of Search ..... 368/64, 66, 76, 368/80, 203–204

[56] References Cited

U.S. PATENT DOCUMENTS

| | | | |
|---|---|---|---|
| 4,441,825 | 4/1984 | Morokawa | 368/204 |
| 4,730,287 | 3/1988 | Yoshino et al. | 368/205 |
| 4,939,707 | 7/1990 | Nagao | 368/64 |
| 5,001,685 | 3/1991 | Hayakawa | 368/204 |
| 5,130,960 | 7/1992 | Hayakawa | 368/204 |
| 5,278,806 | 1/1994 | Affolter | 368/204 |

FOREIGN PATENT DOCUMENTS

| | | |
|---|---|---|
| 0239820 | 10/1987 | European Pat. Off. . |
| 2339280 | 8/1977 | France . |
| 1552669 | 9/1979 | United Kingdom . |

*Primary Examiner*—Vit W. Miska
*Attorney, Agent, or Firm*—Adams & Wilks

[57] ABSTRACT

A compact and thin electronic control timepiece having a long duration time for indicating highly accurate time. The flow of an AC electromotive force induced in a coil in a generator powered by a power spring is supplied to a step-up circuit in an IC. The step-up circuit boosts the rectified electromotive force doubling to charge in a smoothing capacitor as storage power. A step-up control circuit generates a step-up control signal for controlling the step-up operation of the step-up circuit. A cycle comparing circuit compares a reference cycle signal from an oscillation circuit and a detected cycle signal synchronized with the rotational cycle of the generator, generates a cycle correction signal for eliminating a time difference between both signals, and outputs the signal to a load control circuit. The load control circuit in turn changes a load current on the generator by appropriately selecting a load resistor for changing switching elements within an internal circuit, controls the amount of an electromagnetic brake corresponding to a current amount flowing through the load resister and thereby governs the speed of the rotation cycle of the generator.

9 Claims, 23 Drawing Sheets

ELECTRONIC CONTROL TIMEPIECE

This is a continuation of parent application Ser. No. 08/510,424, filed Aug. 2, 1995, now abandoned.

BACKGROUND OF THE INVENTION

The present invention relates to an electronic control timepiece using a power spring as a power source, and having a generator driven by the power spring and an electronic governing means operated by the electromotive force of the generator.

A conventional type of electronic control timepiece for governing speeds by using an electronic circuit with a power spring as a power source is shown in FIGS. 3 and 4. FIG. 3 is a circuit block diagram and FIG. 4 is a block diagram showing a system including such mechanism parts as a power spring, etc.

As shown in FIG. 4, timepiece hands 12 are moved and a generator 3 rotated by mechanical energy 101 stored in the power spring 1 of a timepiece via a speed increasing gear train 2. By means of the rotation of the generator 3 an electromotive force 102 is induced on both ends of a coil therein and the electromotive force 102 is temporarily stored in a smoothing capacitor 4 electrically connected to the coil as a storage power 108. An integrated circuit (hereinafter abbreviated as IC) including an oscillation circuit 7 functioning by means of a quartz oscillator 10, a frequency dividing circuit 6, a cycle comparing circuit 8, a cycle detecting circuit 9, a load control circuit 5 and the like are driven by the storage power 108. The frequency of a signal oscillated by the operation of the quartz oscillator 10 is divided to given cycles via the oscillation circuit 7 and the frequency dividing circuit 6. The divided frequency signal is outputted to the cycle comparing circuit 8 as a reference cycle signal having a cycle of, for example, 1 second.

The cycle detecting circuit 9 fetches an induced voltage 104 synchronized with the rotation cycle of the generator 3 and outputs a detected cycle signal 105 to the cycle comparing circuit 8. The cycle comparing circuit 8 compares each cycle of the reference cycle signal and the detected cycle signal, obtains a time difference between both signals and generates a cycle correction signal 106 for correcting the rotation cycle of the generator 3 and outputs it to the load control circuit 5 so as to eliminate the difference, that is, to synchronize the cycle of the generator 3 with the cycle of the reference cycle signal.

The load control circuit 5 suitably selects a load resistor by switching a switch within the circuit and thereby changes the load current of the generator 3, that is, the amount of current 107 flowing to the coil of the generator 3, and governs the speed of the rotation cycle of the generator 3 by controlling the amount of an electromagnetic brake corresponding to the amount of current. Then, it synchronizes the rotation cycle of the generator 3 with a reference cycle signal generated by the IC and the quartz oscillator 10, to make the cycle constant. Then, by making constant the moving cycle of the hands 12 linked with the speed increasing gear train 2 for driving the generator 3, chronologically precise time is maintained.

FIG. 3 shows connections among the circuits mentioned above.

Electronic control timepieces based on such a principle are described in, for example, Published Unexamined Japanese Patent Applications Nos. 59-135388 (1984) and 59-116078 (1984).

The following description relates to what is termed "duration time" in such electronic control timepieces, that is the time during which a power spring is gradually released from the state where it is wound to its limit and the hands can indicate accurate time. The duration time, as shown in FIG. 5, is determined by the release angle θ of the power spring where a relation between a power spring torque Tz and a minimum loss torque Thmin following the rotation of the generator becomes;

$$Tz<Thmin\times Z,$$

wherein Z indicates a speed increasing ratio of the gear train from the power spring to the generator.

More specifically, if the rotation cycle of the generator is t, the release angle Δθ of the power spring per unit time is determined by;

$$2\pi/(t\times Z).$$

A value (θ/Δθ) obtained by dividing the release angle θ of the power spring by the angle Δθ becomes duration becomes in the electronic control timepiece. Thus, the larger the speed increasing ratio Z, or the longer the rotation cycle t of the generator, the longer the duration time.

The rotation cycle t of the generator must satisfy the following conditions:

1. The rotation cycle of the generator must always be constant. Since the hands linked via the speed increasing gear train indicate time, the rotation cycle of the hands is predetermined (for example, the cycle of the second hand is one minute per one rotation). Thus, it is necessary for the generator to always rotate at a constant rotation cycle.

2. An electromotive force generated by the generator which rotates at a constant cycle must have sufficient electric power to secure stable operation of the IC and the quartz oscillator.

This is because the IC including the quartz oscillator is driven by power generated by the generator and temporarily stored in the smoothing capacitor.

3. In order to obtain sufficient electromotive force, loss of torque produced when the generator rotates must not be increased. That is, the rotation cycle of the generator coincides with a rotation cycle at a time of equilibrium between the power spring torque Tz and Th×z, where Th×z means that the sum total of loss torque such as magnetic loss torque, mechanical loss torque and the like produced by the rotation of the generator is multiplied by a speed increasing ratio Z. For this reason, when the loss of torque Th becomes;

$$Th\times Z>Tzmax$$

with respect to a maximum torque value Tzmax possessed by the power spring, the hand movement cycle necessary for the timepiece cannot be ensured.

The generator of an electronic control timepiece is rotated under the above three conditions relating to the rotation cycle thereof.

The following description concerns the relationship between the number of rotations of a generator and various characteristics such as the induced voltage of a coil, magnetic loss torque, mechanical loss torque and the like, referring to FIGS. 6, 7 and 8. Herein, the relationship between a rotation cycle t and the number of rotations ω is expressed by;

$$1/t=\omega.$$

FIG. 6 is a graph showing the relationship between the number of rotations ω of a generator and an induced voltage E charged from the generator to the smoothing capacitor. As shown by a solid line (A) in FIG. 6, with the increase of the number of rotations of the generator, the induced voltage E increases. When the generator rotates at a number of its rotations ω1, the induced voltage E reaches its operational voltage El, that is, a voltage sufficient to secure the stable operation of the IC, including a quartz oscillation circuit.

FIG. 7 is a graph showing the relationship between the number of rotations ω of a generator and mechanical loss torque Ts. The mechanical loss torque increases with an increase in the number of rotations of a generator. The mechanical loss torque changes depending on the number of rotations of the generator and becomes Ts1 when the number of rotations is ω1.

FIG. 8 is a graph showing the relationship between the number of rotations of a generator and magnetical loss torque. The magnetic loss torque includes eddy-current loss torque and hysteresis loss torque. A sum of these two torque loses is the magnetic loss torque. The eddy-current loss torque increases with an increase in the number of rotations of the generator. On the other hand, the hysteresis loss torque is constant, having no relationship with the number of generator rotations, and is produced following consumption of energy made when a magnetic domain formed of a magnetic material on a magnetic path is inverted in accordance with the change of magnetic flux of a rotor magnet. The magnetic loss torque is Tu1 when the number of rotations of the generator is ω1.

To sum up, minimum loss torque Thmin when the generator is rotated at a number of its rotations ω1 is expressed by;

$$Thmin=Ts1+Tu1+Tg.$$

Where, Tg indicates electrical loss torque to be electrically consumed by the IC, including an oscillation circuit which is an electrical load on the generator, etc.

In the electronic control timepiece operated under the conditions mentioned above, the voltage of the smoothing capacitor is determined by a voltage induced by the generator. Thus, in the case where the operational voltage of the IC including the quartz oscillation circuit is high, it is necessary to increase the voltage induced by the generator. Conventionally, in order to increase a voltage induced by the generator, such measures as making the rotation cycle of the generator short by increasing the speed increasing ratio of the gear train, improving the magnetic characteristic of the generator, increasing the number of windings of the generator coil or the like, have generally been employed.

However, the conventional type of electronic control timepiece described above has the following problems.

If, as a first measure, the number of rotations of the generator is increased to ω2 and an induced voltage is increased to E2 based on the characteristic shown by a solid line (A) in FIG. 6, mechanical loss torque is also increased to Ts2 as shown in FIG. 7 and magnetic loss torque is increased to Tu2 as shown in FIG. 8. This results in the increase of the sum of these losses of torque, that is, minimum loss torque Thmin produced by the rotation of the generator.

If, as a second measure, the number of interlinking magnetic fluxes of a coil is increased by constructing the magnet included in the generator so as to make a large energy product or permeance, the characteristic shown by a broken line (B) in FIG. 6 is obtained. In this case, although an induced voltage can be increased to E2 while the number of rotations of the generator is maintained at ω1, magnetic loss torque also increases to Tu2 as shown by a broken line in FIG. 8. Ultimately, this results in an increase in the minimum loss torque Thmin produced by the rotation of the generator.

If, as a third measure, the number of windings of the coil is increased, the characteristic shown by the broken line (B) in FIG. 6 is again obtained and thus the induced voltage may increase. In this case, however, the length or thickness of the coil increases. Also, in the case where the coil is made long, the length of the magnetic path is increased and thus magnetic loss torque increases.

To sum up the problems:

(1) Since the minimum loss torque Thmin of the generator is increased in the first and second measures, duration time is shortened. That is, as shown in FIG. 5, when the minimum loss torque increases from Thmin1 to Thmin2, the duration time is shortened from D1 to D2.

(2) Since the space occupied by the generator is expanded in the third measure, the shape of a timepiece is large, leading to a decrease in its commercial value.

If the space occupied by the power spring is expanded so as to make the duration time longer, this also leads to a decrease in the commercial value of the timepiece.

SUMMARY OF THE INVENTION

It is an object of the present invention to provide an electronic control timepiece capable of allowing a smoothing capacitor thereof to maintain a high voltage, ensuring stable operation of the IC thereof and providing highly accurate time as a timepiece without reducing its commercial value as a timepiece by enlarging its form, shortening its duration time, etc.

According to the present invention, in order to solve the problems mentioned above, the electronic control timepiece is provided with a power spring for storing mechanical energy which powers the timepiece, a speed increasing gear train for transmitting mechanical energy stored in the power spring while gradually releasing the mechanical energy, a generator driven by the speed increasing gear train for generating AC induced power and converting mechanical energy into electric energy, a step-up circuit for generating a step-up voltage produced by boosting the voltage of the AC induced power generated by the generator to a predetermined voltage level, a smoothing capacitor charged by a step-up voltage generated by the step-up circuit for storing electrical energy generated by the generator, a quartz oscillation circuit driven by electrical energy stored in the smoothing capacitor for outputting an oscillation signal of a predetermined frequency, a frequency dividing circuit for dividing the frequency of an oscillation circuit outputted from the quartz oscillation circuit and outputting a reference cycle signal of a predetermined cycle, a cycle detecting circuit for outputting a detected cycle signal corresponding to the rotation cycle of the generator in response to the AC induced power generated by the generator, a cycle comparing circuit for comparing each cycle of the reference cycle signal outputted from the frequency dividing circuit and the detected cycle signal outputted from the cycle detecting circuit and outputting a cycle correction signal corresponding to a difference between both signals, a variable load circuit for changing an electrical load on the generator in response to a cycle correction signal outputted from the cycle comparing circuit by controlling electrical loss torque of the generator whereby the rotation cycle of the generator coincides with a predetermined cycle corresponding to the reference cycle signal, and hands coupled with the speed increasing gear train and moved at a predetermined cycle corresponding to the rotation cycle of the generator for indicating time.

The step-up circuit can be constructed in such a way that it is provided with a plurality of capacitors and a plurality of switching elements, and the plurality of switching elements being periodically switched so as to charge induced power produced by the generator by connecting the plurality of capacitors in parallel and discharge electricity to the smoothing capacitor by connecting the plurality of charged capacitors in series.

It is possible to provide a step-up control circuit for controlling the step-up circuit, the step-up control circuit outputting a step-up control signal synchronized with a detected cycle signal in response to the detected cycle signal outputted from the cycle detecting circuit, and ON/OFF switching of the plurality of switching elements in the step-up circuit being controlled by means of the step-up control signal outputted from the step-up control circuit to thereby perform a step-up operation in synchronization with the detected cycle signal.

It is also possible for the step-up control circuit to be provided with a function for controlling the step-up multiplication ratio of the step-up circuit, outputting a step-up control signal synchronized with a detected cycle signal in response to the detected cycle signal outputted from the cycle detecting circuit, changing the step-up multiplication ratio of the step-up circuit in response to a cycle correction signal outputted from the cycle comparing circuit whereby the electric load on the generator is changed, and the rotation cycle of the generator coincides with a predetermined cycle corresponding to a reference cycle signal by controlling electrical loss torque from the generator, thereby providing the step-up circuit with the function of a variable load circuit.

It is further possible for the step-up circuit to include a sub-capacitor serially connected to the generator, a terminal voltage of the sub-capacitor being superimposed on a voltage induced by the generator independently of the cycle of a detected cycle signal outputted from the cycle detecting circuit to boost a voltage charged to the smoothing capacitor.

It is further possible for the step-up circuit to be provided with a first step-up circuit including a plurality of capacitors and a plurality of switching elements, the plurality of switching elements being periodically switched so as to charge induce power induced by the generator by connecting the plurality of capacitors in parallel and discharging electricity of the capacitors to the smoothing capacitor by connecting the plurality of capacitors in series, and a second step-up circuit including a sub-capacitor serially connected to the generator with its terminal voltage superimposed on a voltage induced by the generator independently of the cycle of a detected cycle signal outputted from the cycle detecting circuit for boosting a voltage charged to the smoothing capacitor.

It is still further possible for the variable load circuit to include a load control circuit having a switching element and a resistor, the switching element cyclically controls ON/OFF switching of connections between the resistor and the generator in response to a cycle correction signal outputted from the cycle comparing circuit and thereby changing the load on the generator.

In the electronic control timepiece thus constructed, it is possible to boost the potential of the smoothing capacitor by synchronizing it with an induced voltage generated in the generator and operating the step-up circuit by producing a step-up control signal.

Also, by changing the step-up magnifying ratio of the step-up circuit it is possible to change a load current on the generator and thereby to govern its speed with the number of rotations of the generator kept constant.

By constituting the step-up circuit by a sub-capacitor and a diode, it is possible to obtain a step-up effect independently of the operation of the IC.

DETAILED DESCRIPTION OF THE PREFERRED EMBODIMENTS

The preferred embodiments according to the present invention will be described with reference to the accompanying drawings hereinbelow.

Embodiment 1

A first embodiment according to the present invention is described with reference to FIGS. 1 and 2.

Figure 1:
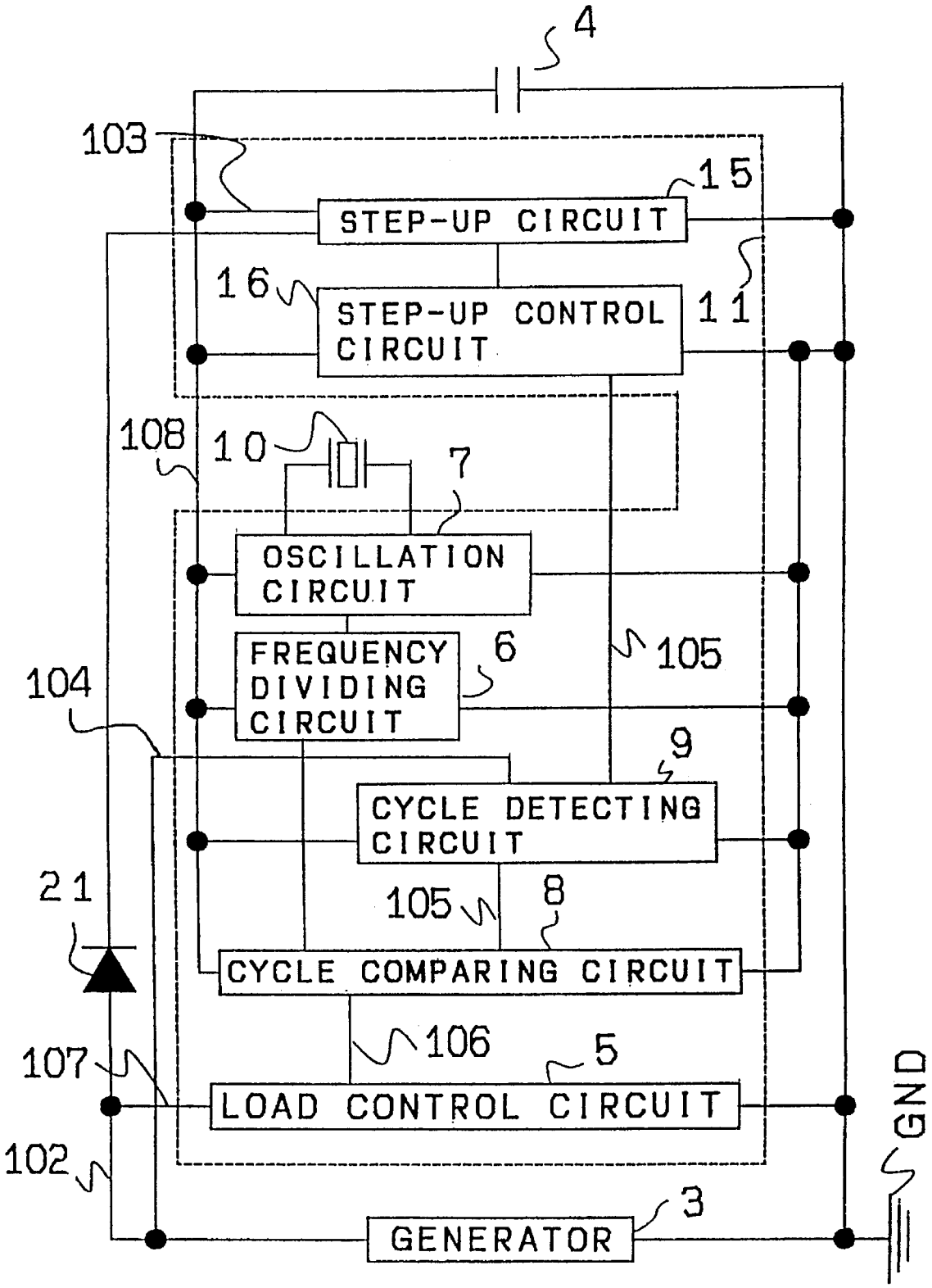
FIG. 1 is a circuit block diagram of an electronic control timepiece of the first embodiment of the present invention.
Figure 2:
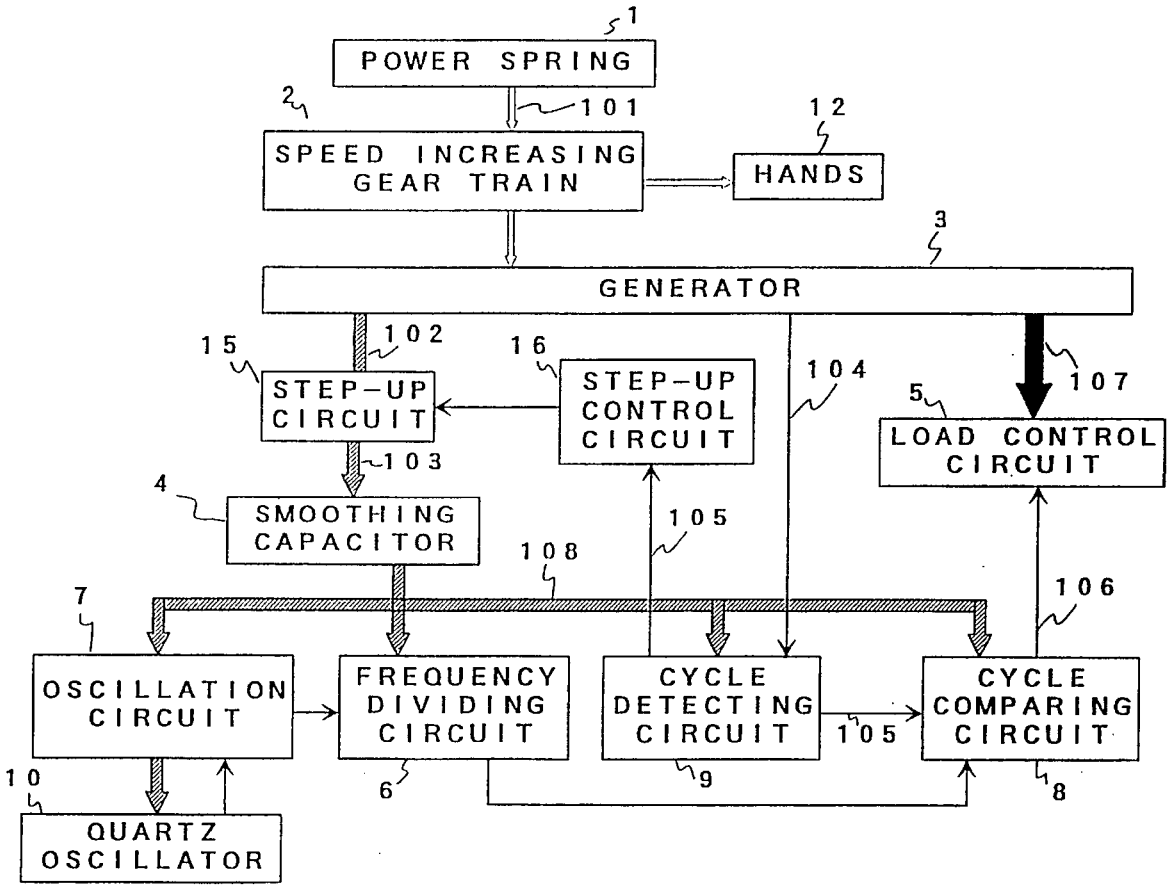
FIG. 2 is a block diagram showing energy transmission of an electronic control timepiece according to the present invention.
Figure 3:
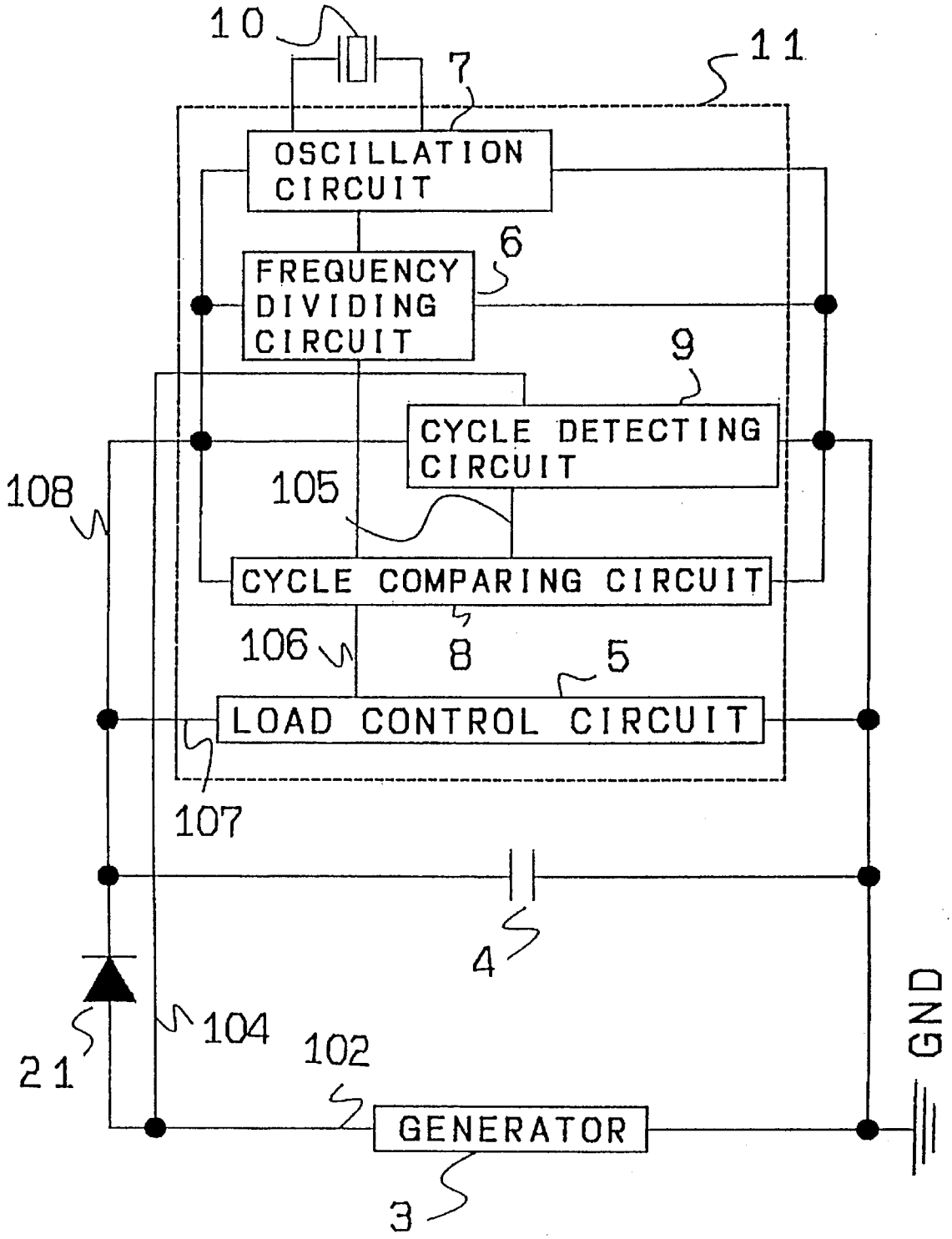
FIG. 3 is a circuit block diagram of a conventional electronic control timepiece.
Figure 4:
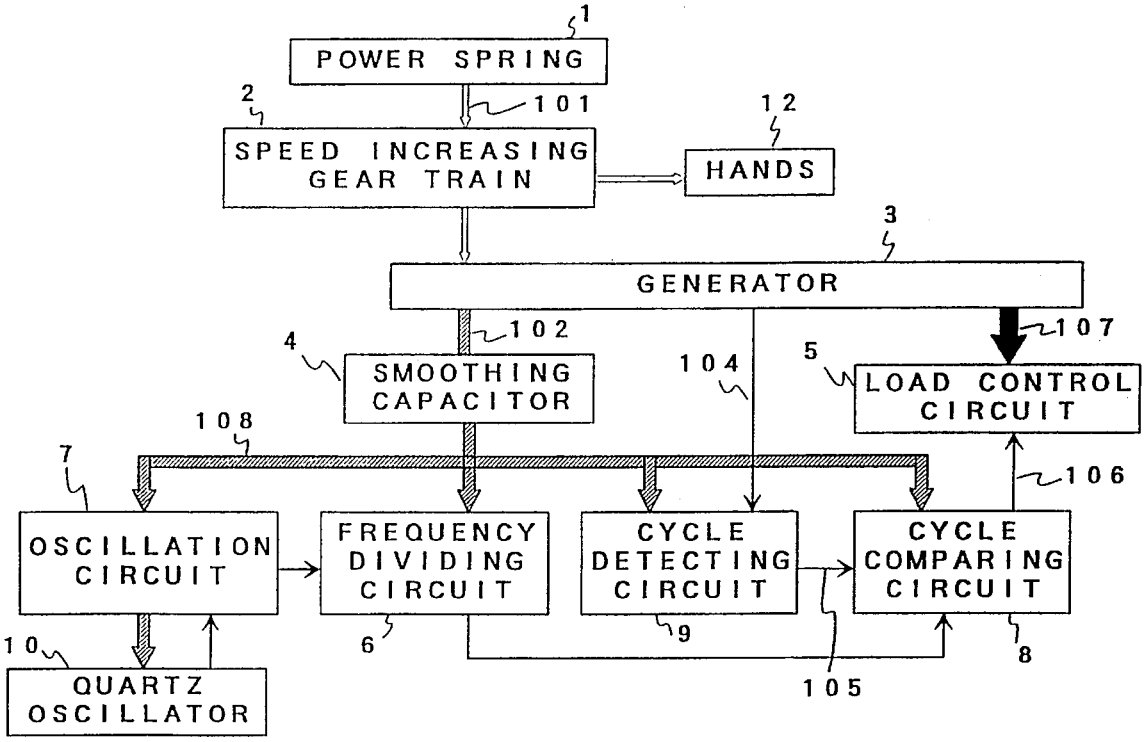
FIG. 4 is a block diagram showing the energy transmission of a conventional electronic control timepiece.
Figure 5:
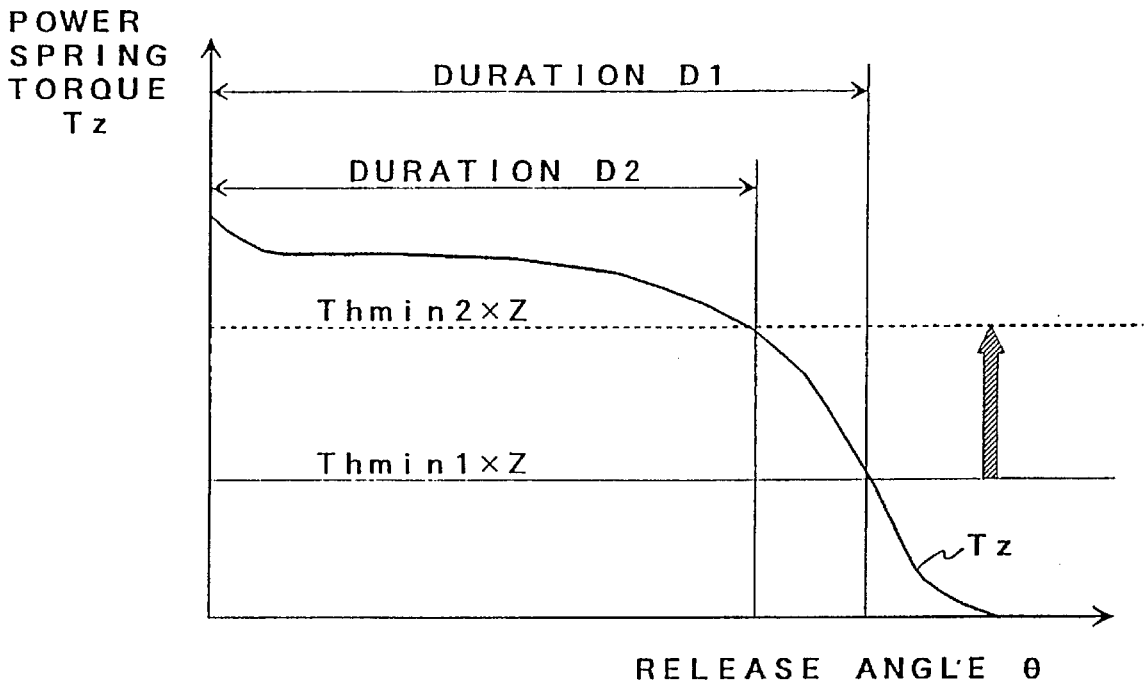
FIG. 5 is a view showing the power spring of an electronic control timepiece, its release angle and loss torque of a generator.

FIG. 1 is a block diagram showing a circuit in the first embodiment while FIG. 2 is a block diagram showing the system of an electronic control timepiece including such mechanism parts as a power spring and the like and a step-up circuit 15 in the first embodiment.

In FIG. 2, a power spring 1 stores mechanical energy 101 which powers a timepiece. This mechanical energy 101 moves timepiece hands 12 via a speed increasing gear train 2 and rotates a generator 3. By the rotation of the generator 3 an electromotive force is induced on both ends of a coil therein.

In FIG. 1, one end of the coil in the generator 3 is connected to a diode 21 and a load control circuit 5 provided in an IC 11 (a part surrounded by a broken line in FIG. 1), and the other end is grounded to a GND. The diode 21 rectifies the current produced by an AC electromotive force 102 induced by the generator 3. The rectified current is supplied to the step-up circuit 15 in the IC 11. The step-up circuit 15 generates, for example, a step-up voltage 103 twice as high as the electromotive force 102 therefrom when necessary. The step-up voltage 103 is temporarily stored as storage power 108 in a smoothing capacitor 4 arranged in parallel with the step-up circuit 15. A step-up control circuit 16 generates a step-up control signal for controlling the boosting operation of the step-up circuit 15. The smoothing capacitor 4 allows the IC 11 to be continuously driven by constantly supplying the stored storage power 108 thereto.

The IC 11 includes an oscillation circuit 7, a frequency dividing circuit 6, a cycle comparing circuit 8, a cycle detecting circuit 9, a load control circuit 5, a step-up circuit 15 and a step-up control circuit 16. One end of the respective circuits are grounded to the GND.

The oscillation circuit 7 is electrically connected to a quartz oscillator 10 and outputs an oscillation clock signal to the frequency dividing circuit 6. The frequency dividing circuit 6 in turn generates a reference cycle signal of, for example, 1 second cycle by using the oscillation clock signal and outputs it to the cycle comparing circuit 8.

The cycle detecting circuit 9 fetches an induced voltage 104 from the generator 3, generates a detected cycle signal 105 synchronized with the rotation cycle of the generator 3 and outputs it to the cycle comparing circuit 8 and the step-up control circuit 16.

The cycle comparing circuit 8 compares a cycle of the reference cycle signal generated by the frequency dividing circuit 6 and a cycle of the detected cycle signal generated by the cycle detecting circuit 9, generates a cycle correction signal 106 for eliminating a time difference between both signals and outputs it to the load control circuit 5.

The step-up control circuit 16 generates a step-up control signal from the detected cycle signal and outputs it to the step-up circuit 15. The step-up circuit 15 in turn, based on the step-up control signal, carries out a boosting operation at the cycle of the induced voltage 104, that is, at a timing when it is synchronized with the rotation cycle of the generator 3.

The load control circuit 5 changes a load current on the generator 3, that is, the amount of a current 107 flowing to a coil in the generator 3, by appropriately selecting a load resistor by changing the switching elements within the internal circuit, controls the amount of an electromagnetic brake corresponding to the amount of a current 107 and thereby governs the speed of the rotation cycle of the generator 3. ON/OFF switching of the switching element provided on the load control circuit 5 are carried out corresponding to the cycle correction signal 106.

When the switching element is turned ON, an electric closed loop is formed between the generator 3 and the load control circuit 5. At this time, depending on the potential difference of an electromotive force generated in the coil in the generator 3, a current flows to the load control circuit 5 and power is consumed. Then, an electromagnetic brake is applied to the generator and thereby the rotation cycle of the generator 3 is made long.

On the other hand, when the switching element is turned OFF, an electric open-loop is formed between the generator 3 and the load control circuit 5. At this time, no current flows to the load control circuit 5 and no power is consumed therein. Thus, an electric load on the generator is reduced and thereby the rotation cycle of the generator 3 is made short.

Then, by synchronizing the rotation cycle of the generator 3 with a reference cycle generated by the quartz oscillator 10 and the IC, its rotation cycle is made coincident with a predetermined constant cycle. That is, in the case where a second hand is rotated accurately at 1 rpm, the rotation cycle of the generator 3 is made to the one corresponding to a rotation speed increased or decreased by the amount of a speed increasing ratio ZZ from the second hand to the generator 3, the moving cycle of the hands 12 linked with the speed increasing gear train 2 driving the generator 3 is made constant and thereby time accuracy is secured.

Herein, the load control circuit 5 is used to govern speeds of the generator 3 by means of controlling an electric load thereon. However, it may not be necessary when an electric load can be controlled by other means.

Figure 6:
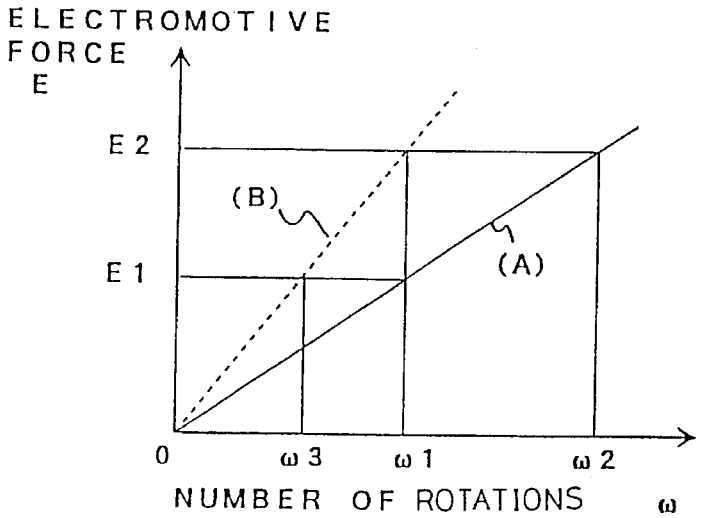
FIG. 6 is a view showing a relationship between the number of rotations and the induced voltage of a generator in an electronic control timepiece.
Figure 7:
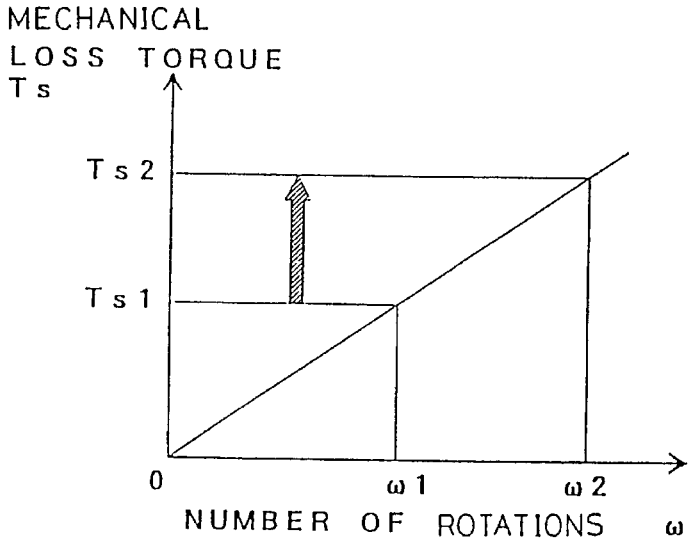
FIG. 7 is a view showing a relationship between the number of rotations and the mechanical loss torque of a generator in an electronic control timepiece.
Figure 8:
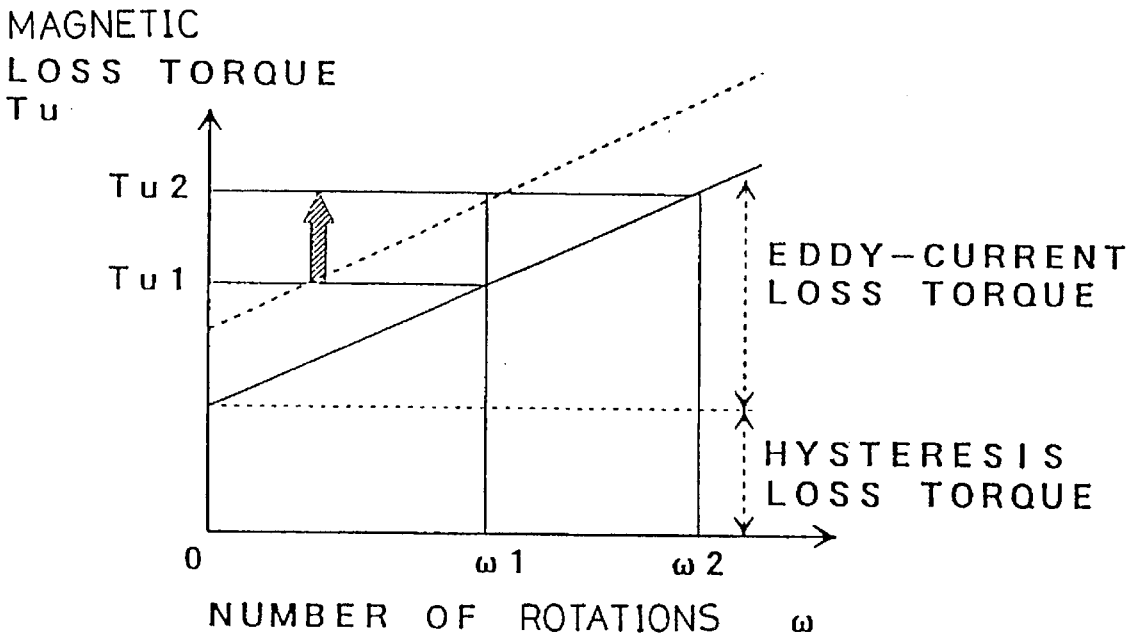
FIG. 8 is a view showing a relationship between the number of rotations and the magnetic loss torque of a generator in an electronic control timepiece.

The following description is made relating to connections between the number of rotations of the generator and mechanical loss torque or magnetic loss torque with reference to FIGS. 6, 7 and 8.

When the rotational number $\omega$ of the generator is kept at $\omega 1$ and an induced voltage E is E1, the voltage can be boosted to E2 by using the step-up circuit 15. This means that the characteristic of the generator is apparently improved from the one shown by a solid line (A) to the one shown by a broken line (B) in FIG. 6. Consequently, an induced voltage E2 can be equivalently obtained while the number of rotations is kept at ω1 without being increased to ω2. Then, in this state, the mechanical loss torque is kept at Ts1 as shown in FIG. 7 and the magnetic loss torque is kept at Tu1 as shown in FIG. 8. Thus, by providing the step-up circuit 15 it is possible to prevent increases of the mechanical as well as magnetic loss torque and to secure a high induced voltage.

On the other hand, in the case where the amount of a step-up voltage which is necessary is enough at E1, the number of rotations of the generator can be made less than ω1. That is, by using the step-up circuit 15, the number of rotations of the generator can be reduced from ω1 to ω3 based on a characteristic indicated by a broken line (B) in FIG. 6. Reduction in the number of rotations of the generator can be an effective means of making the duration time of a power spring long.

Figure 9:
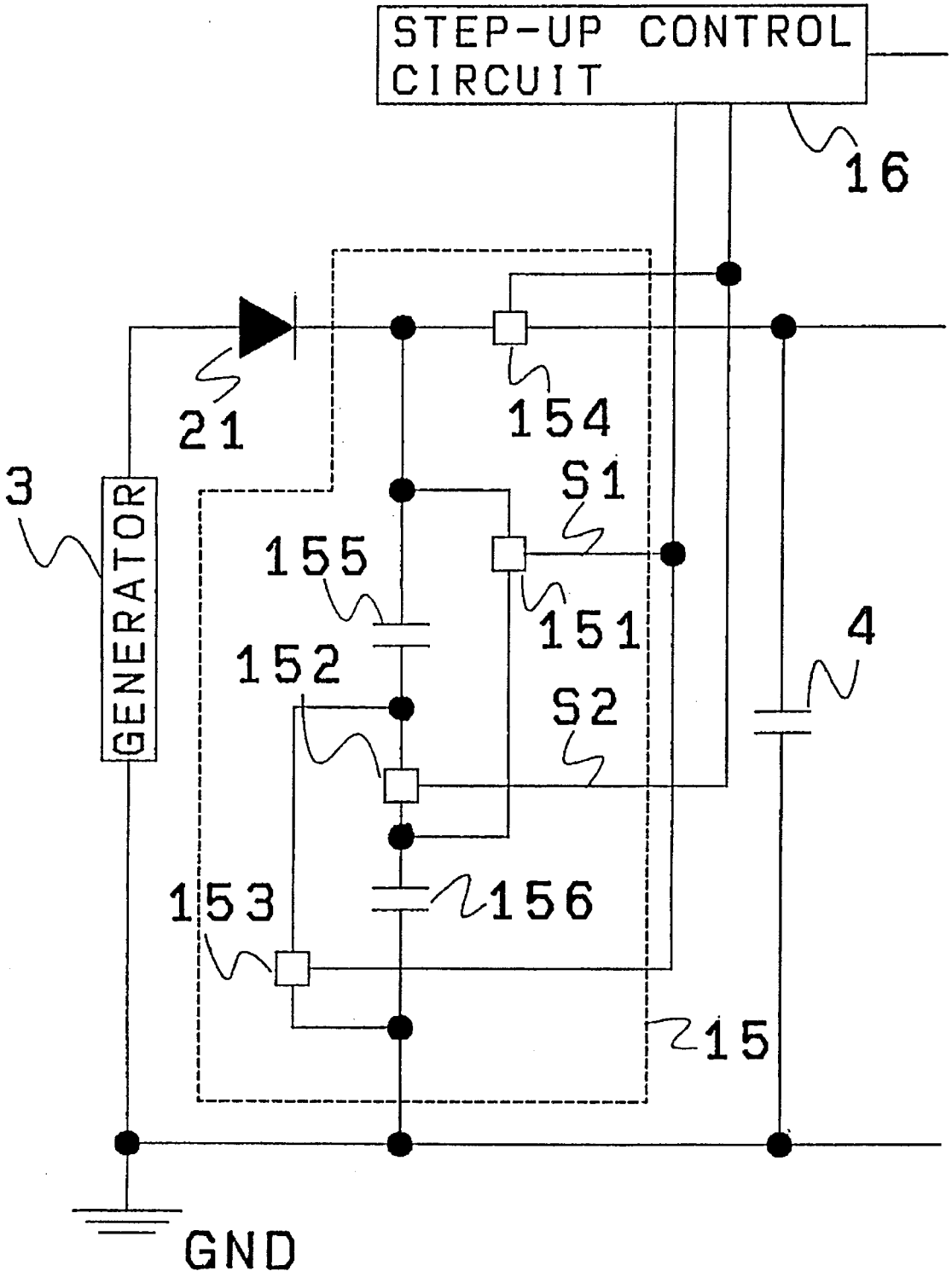
FIG. 9 is a circuit block diagram of a step-up circuit in the preferred embodiments of the present invention.
Figure 10A:
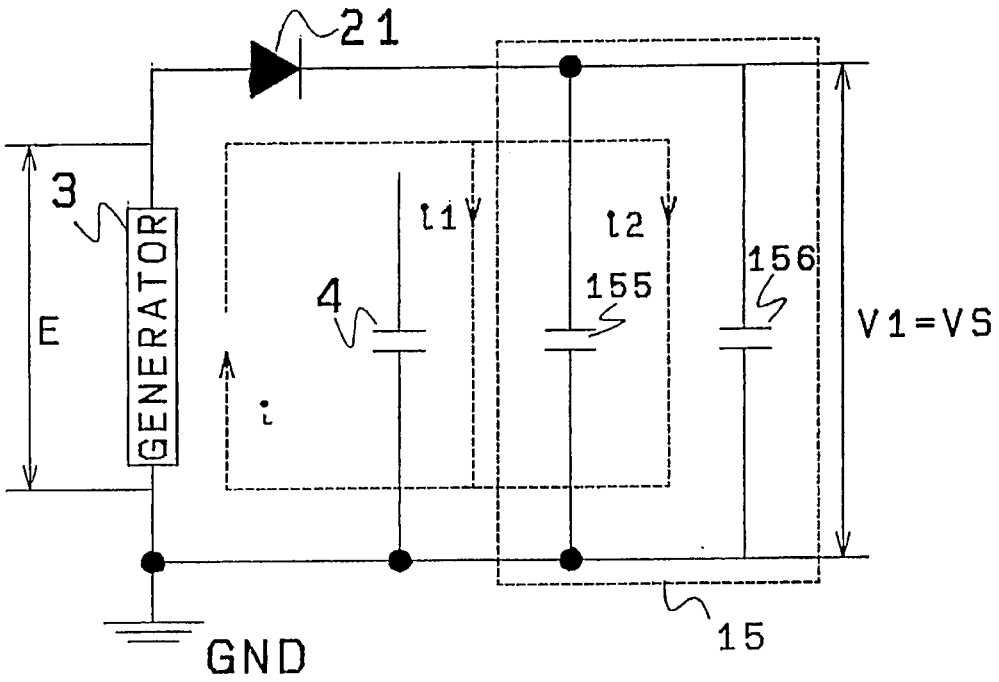
FIG. 10A is a circuit block diagram of connections between a smoothing capacitor and a step-up capacitor before boosting in the third embodiment of the present invention.
Figure 10B:
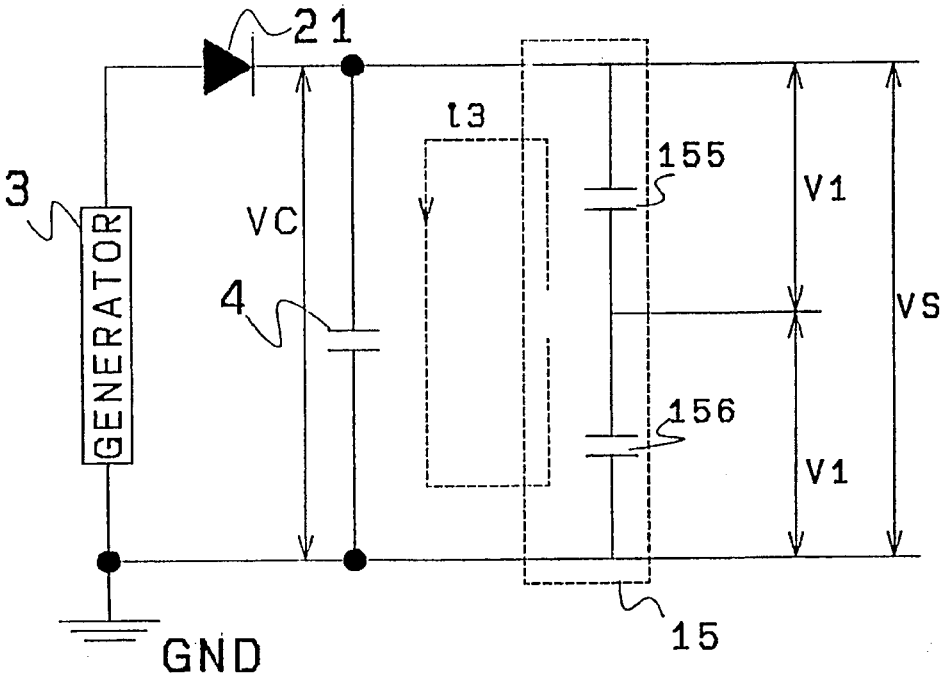
FIG. 10B is a circuit block diagram showing a relationship between a smoothing capacitor and a step-up capacitor at the time of boosting in the third embodiment of the present invention.
Figure 11:
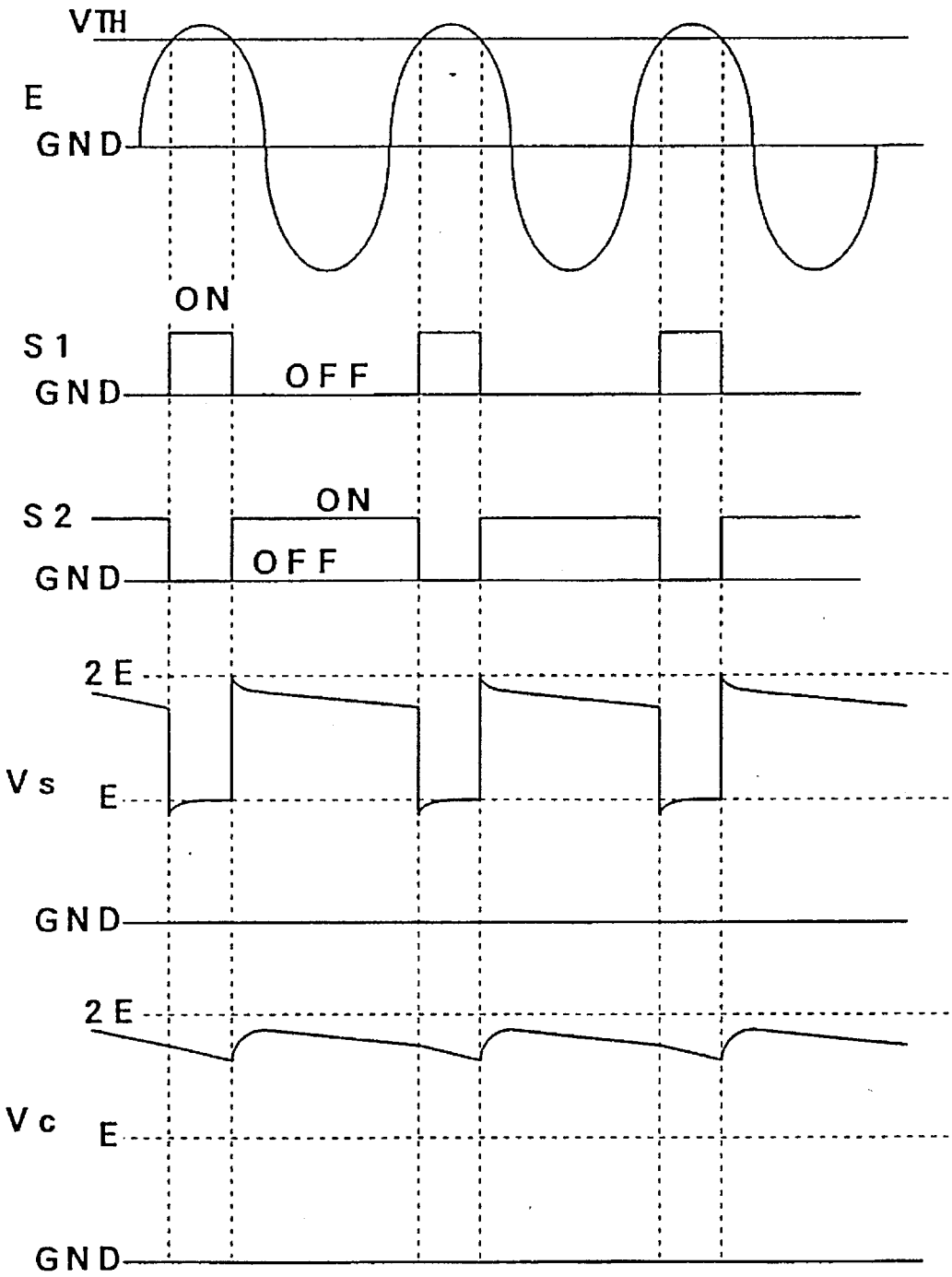
FIG. 11 is a view showing a timing for ON/OFF switching of switching elements in the step-up circuit of an electronic control timepiece.

The following description is made relating to the specific example of the step-up circuit 15 used in the present first embodiment with reference to FIGS. 9, 10 and 11 and a table 1.

FIG. 9 is a circuit block diagram showing a step-up circuit capable of double boosting. The step-up circuit 15 includes switching elements 151, 152, 153 and 154 and step-up capacitors 155 and 156. ON/OFF switching of the switching elements 151, 152, 153 and 154 are controlled by step-up control signals S1 and S2 from the step-up control circuit 16. When the step-up control signals S1 and S2 are in high states (hereinafter termed "H") the switches are switched ON, and when the signals are in low states (hereinafter termed "L") the switches are switched OFF.

FIGS. 10A and 10B respectively show connections among such electric elements as the generator 3, the diode 21, the smoothing capacitor 4 and the step-up capacitors 155 and 156 in the two states when the step-up circuit 15 carries out a boosting operation. The step-up circuit 15 repeats by turns a charged state where the step-up capacitors 155 and 156 are connected in parallel as shown in FIG. 10A and a discharged state where the step-up capacitors 155 and 156 are connected in series as shown in FIG. 10B.

FIG. 11 shows timings for ON/OFF switching of the switching elements provided in the step-up circuit 15 and changes of the potential Vs of the step-up capacitors and potential Vc of the smoothing capacitor at the time of carrying out a boosting operation. In the drawing, a waveform E indicates a voltage induced by the generator 3, the step-up control signal S1 indicates a timing for switching the switching elements 151 and 153 ON and the step-up control signal S2 indicates a timing for switching the switching elements 152 and 154 ON. The ON/OFF states of the step-up control signals S1 and S2 are identified by observing whether the induced voltage E exceeds a reference voltage VTH or not. Moreover, it is not necessary to limit the method of generating step-up control signals to that based on identification by means of a reference voltage.

Table 1 briefly shows the operations of the step-up circuit 15.

[TABLE 1]

| | SWITCHING ELEMENTS | | | | CONNECTION BETWEEN CAPS. |
|---|---|---|---|---|---|
| SECTION | 151 | 152 | 153 | 154 | 155 AND 156 |
| NO STEP-UP | ON | OFF | ON | OFF | IN PARALLEL |
| DOUBLE STEP-UP | OFF | ON | OFF | ON | IN SERIES |

First, explanation is made of a switching operation when the step-up circuit is in a charged state. Of the switching elements provided on the step-up circuit 15, the elements 151 and 153 are switched ON when the step-up control signal S1 becomes "H". On the other hand, since the step-up control signal S2 is kept at "L", the switching elements 152 and 154 are in OFF states.

At this time, as shown in FIG. 10A, the step-up capacitors 155 and 156 are connected in parallel. The step-up capacitors 155 and 156 respectively form electric loops connected in parallel to the generator 3. A current i flowing to the step-up circuit 15 is;

$$i=i1+i2$$

if a current flowing to the step-up capacitor 155 is i1 and a current flowing to the step-up capacitor 156 is i2. Then, the potential of the step-up capacitor Vs is almost an induced voltage E as shown in FIG. 11. That is, if the terminal voltage of the step-up capacitors 155 and 156 is V1;

$$Vs=V1=E$$

is obtained.

Next, explanation is made of a switching operation when the step-up circuit is in a discharged state, that is, in a state for carrying out double boosting. In this state, since the step-up control signal S1 is "L", the switching elements 151 and 153 are switched OFF. On the other hand, since the step-up control signal S2 is "H", the switching elements 152 and 154 are switched ON.

At this time, as shown in FIG. 10B, the step-up capacitors 155 and 156 are connected in series. The step-up capacitors 155 and 156 thus connected in series form electric loops with the smoothing capacitor 4. Then, the potential Vs of the two serially connected capacitors is;

$$Vs=(V1+V1).$$

This potential (V1+V1) exceeds the potential Vc of the smoothing capacitor. This is because, as shown in FIG. 11, the storage power of the smoothing capacitor is always consumed by such electrical elements as ICs and the like and thus the potential Vc is gradually reduced from the initial period of a double boosting state.

Therefore, as shown in FIG. 10B, a current i3 flows between the smoothing capacitor 4 and the step-up circuit 15. Then, the potential Vc of the smoothing capacitor 4, as shown in FIG. 11, increases to a voltage whose potential is substantially equal to the potential Vs of the step-up capacitor. At this time, the potential V1 of the step-up capacitors 155 and 156 declines to Vc/2.

In this way, by generating the step-up control signals S1 and S2 synchronized with the induced voltage E in the generator 3 and switching the switches of the step-up circuit 15 ON and OFF, it is possible to boost the potential of the smoothing capacitor 4 at any time.

Reference has thus far been made to the example of a circuit for carrying out double boosting by using two step-up capacitors with respect to the present embodiment. However, since the step-up multiplication ratio can be tripled or more by using three or more step-up capacitors, it is possible to further increase the potential of the smoothing capacitor with respect to the induced voltage in the generator.

Even in a case where the induced voltage in the generator 3 does not reach the operational voltage of the IC under the construction in the above first embodiment, the smoothing capacitor 4 can store power having a sufficient potential to maintain the operation of the IC. Thus, the characteristic of the generator 3 can be substantially improved without expanding the space occupied by the generator. Also, in a case where the induced voltage in the generator 3 is sufficiently high in the construction described above, it is possible to reduce the number of rotations of the generator by using the step-up circuit. Thus, without expanding the space occupied by the power spring, duration time can be substantially lengthened. Hence it is possible to provide a compact and thin electronic control timepiece having a long duration time.

Further, the switching element 154 of the step-up circuit 15 shown in FIG. 9 can be replaced by a diode. That is, by providing the diode so as to prevent discharging of the storage power of the smoothing capacitor 4 to the side of the step-up capacitor it is possible to obtain the same advantage as ON/OFF switching of the switching element 154.

Still further, although the step-up circuit 15 is provided inside the IC in the first embodiment, similar functions can be performed even if part or all of the circuit elements are provided outside the IC.

Embodiment 2

The following description relates to a second preferred embodiment of the present invention.

In the construction of the second embodiment, by making the step-up multiplication ratio of the step-up circuit 15 variable, the amount of current flowing to an electrically closed loop formed by the generator 3 and the step-up circuit is adjusted, the size of an electromagnetic brake generated in the generator 3 is changed and, thereby, the speed of the rotation cycle of the generator 3 is kept constant. This control of the number of rotations is based on the principle that if an electromotive force induced by the generator and the power expended for stepping up including power consumed by the IC are equalized, the rotation cycle of the generator 3 can be made constant. In this construction, it is unnecessary to use a load control circuit as a means of governing the speed of the generator 3.

It is possible to realize control of the number of rotations mentioned above, because a characteristic is provided wherein power consumed by the IC changes in accordance with a voltage applied thereto, that is, the voltage of the smoothing capacitor. The electric characteristic of the typical IC is shown in FIG. 12.

Figure 12:
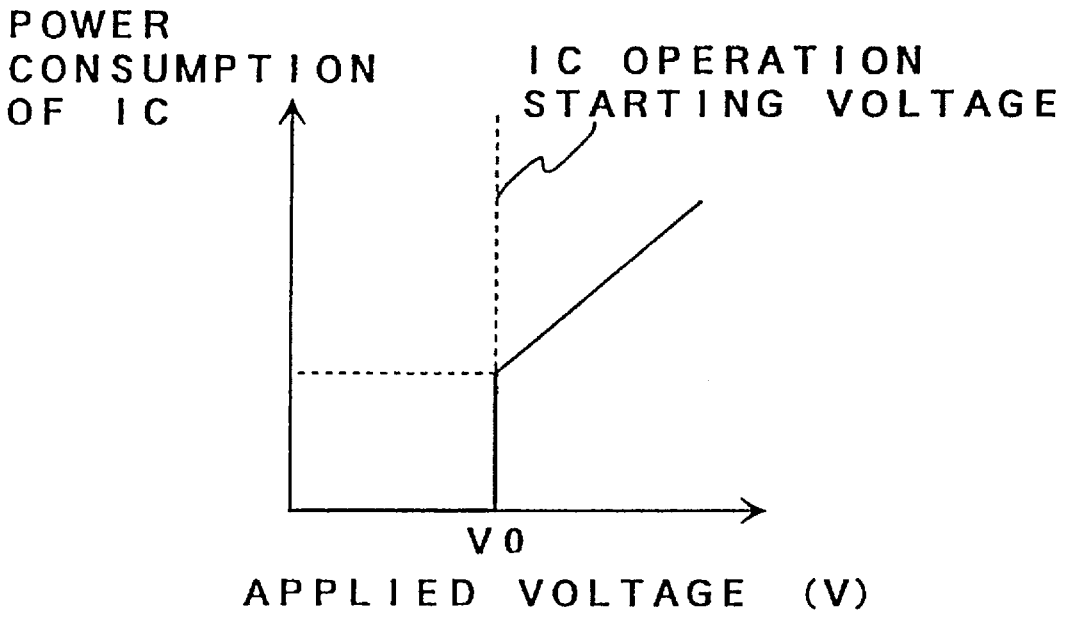
FIG. 12 is a view showing the electric characteristic of an IC.

In FIG. 12, the abscissa indicates a voltage applied to the IC while the ordinate indicates power consumed by the IC per unit time. When the applied voltage exceeds a voltage V0 for starting an IC operation, the IC starts its operation and consumes power. Then, as the applied voltage increases, power consumption also increases.

More specifically, since power consumed by the IC changes when the step-up circuit 15 boosts the potential of the smoothing capacitor 4 and power flowing to the step-up circuit also changes in proportion to power consumed by the IC, the amount of current flowing between the generator and the step-up circuit changes. Further, since the rotation cycle of the generator depends on the amount of current flowing thereto, it is possible to control the rotation cycle thereof by changing the step-up multiplication ratio of the step-up circuit.

Figure 13:
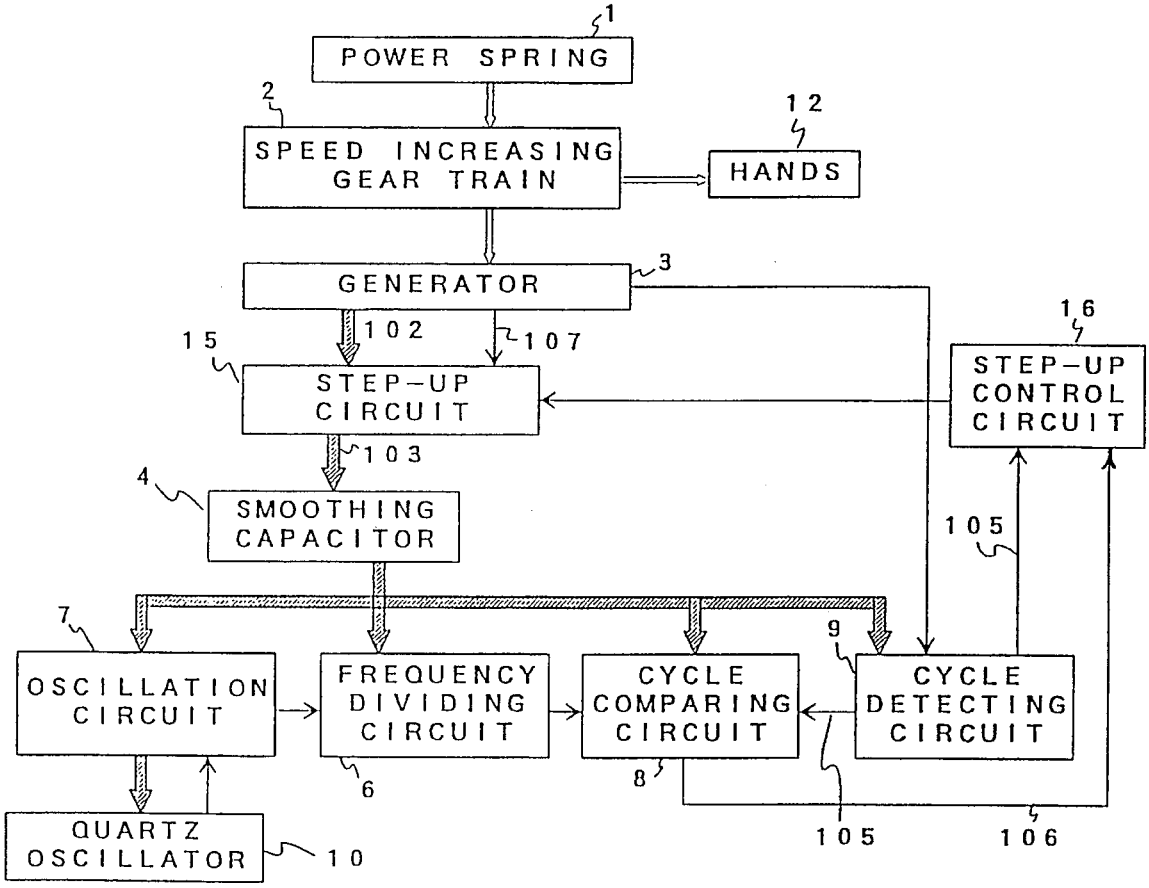
FIG. 13 is a circuit block diagram of a electronic control timepiece in the second embodiment of the present invention.

In the following the operation of a system including the step-up circuit 15 in the second embodiment is explained with reference to the block diagram of FIG. 13.

First, an electromotive force 102 generated at both ends of the coil in the generator 3 is applied to the step-up circuit 15. The step-up circuit 15 executes a boosting operation in response to a step-up control signal generated by the step-up control circuit 16 and thereby boosts the voltage of the electromotive force to a predetermined multiplied ratio.

The smoothing capacitor 4 is charged with a step-up voltage 103 from the step-up circuit 15 and consequently the electromotive force 102 is temporarily stored in the smoothing capacitor 4 as storage power.

The smoothing capacitor 4 is electrically connected to the IC 11 and it is possible to continuously drive the IC 11 by constantly supplying the storage power in the smoothing capacitor 4 thereto. The signal oscillated by the operation of the quartz oscillator 10 is divided into predetermined cycles from the oscillation circuit 7 via the frequency dividing circuit 6. The frequency-divided signal is outputted to the cycle comparing circuit 8 as a reference cycle signal of, for example, 1 second period.

The cycle detecting circuit 9 fetches an induced voltage 104 from the generator 3, generates a detected cycle signal 105 synchronized with the rotation cycle of the generator 3 and outputs it to the cycle comparing circuit 8 and the step-up control circuit 16.

The cycle comparing circuit 8 compares each cycles of a reference cycle signal generated by the frequency dividing circuit 6 and a detected cycle signal generated by the cycle detecting circuit 9, generates a cycle correction signal 106 for eliminating a time difference between both signals, and outputs it to the step-up control circuit 16.

The step-up control circuit 16 generates a step-up control signal based on the cycle correction signal and the detected cycle signal and outputs it to the step-up circuit 15.

The step-up circuit 15 changes connections among a plurality of capacitors provided in parallel or in series thereon by switching the switches of the circuit. ON/OFF switching of the switching elements on the step-up circuit 15 are carried out in accordance with the step-up control signal generated by the step-up control circuit 16. Then, by appropriately changing a step-up multiplication ratio a load current on the generator 3, that is, the current amount 107 flowing from the coil in the generator 3 to the step-up circuit 15, is changed, the amount of an electromagnetic brake corresponding to the current amount 107 is controlled, and thereby the speed of the number of rotations of the generator 3 is governed.

Further, transmission of mechanical energy from the power spring 1 to the generator 3 and transmission of electric energy from the smoothing capacitor 4 to the IC 11 and the quartz oscillator 10 are similar to those in the first embodiment described with reference to FIG. 2.

In the following relationships among a step-up multiplication ratio $\alpha$, the number of rotations $\omega$ of the generator and power spring torque Tz are explained with reference to FIG. 14.

Mechanical energy Ez supplied from the power spring 1 to the generator 3 is represented by the following expression;

$$Ez=Tz\times g\times 2\pi\times\omega/Z.$$

Where, g=gravitational acceleration, Z=speed increasing ratio from the power spring 1 to the generator 3.

On the other hand, power Ei consumed by the IC is represented by the following expression;

$$Eic=(\alpha\times k\times 2\pi\times\omega)^2/R.$$

Where, k =power generation coefficient and R=electric resistance value.

Given this, the relationship between energy Ez possessed by the power spring and power Ei consumed by the IC is represented by the following expression;

$$\rho\times Ez=Eic$$

Where, ρ=energy transmission efficiency.

Indicating this relationship by the step-up multiplication ratio α, the number of rotations ω of the generator and the power spring torque Tz, the following expression is obtained;

$$TZ/\alpha^2\propto\omega$$

Figure 14:
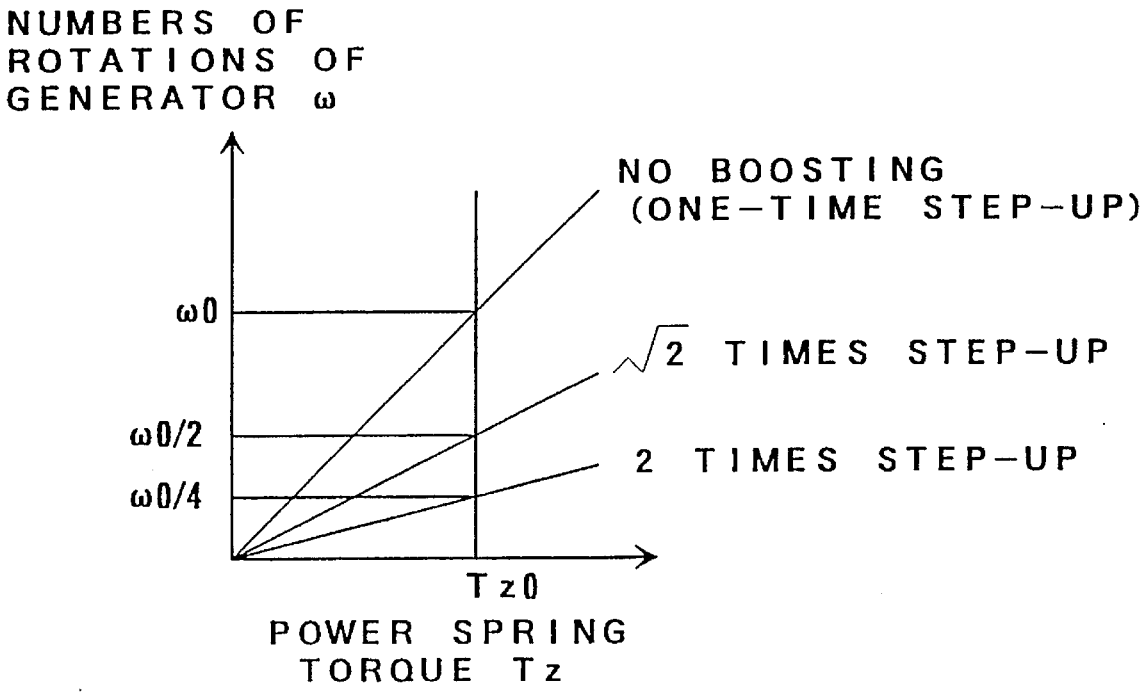
FIG. 14 is a view showing a relationship between the number of rotations of a generator and power spring torque.

This relationship is shown in the graph of FIG. 14.

When the power spring torque Tz is maintained constant at a value Tz0, if the number of rotations of the generator is ω0 if no boosting occurs (one time step-up), by increasing the step-up multiplication ratio α the number of rotations ω0 is reduced. That is, the number of rotations becomes (ω0/2) by √2 times step-up and becomes (ω0/4) by double step-up.

In the present second embodiment, such a relationship between the step-up multiplication ratio α and the number of rotations ω is used for controlling the number of rotations of the generator.

Figure 15:
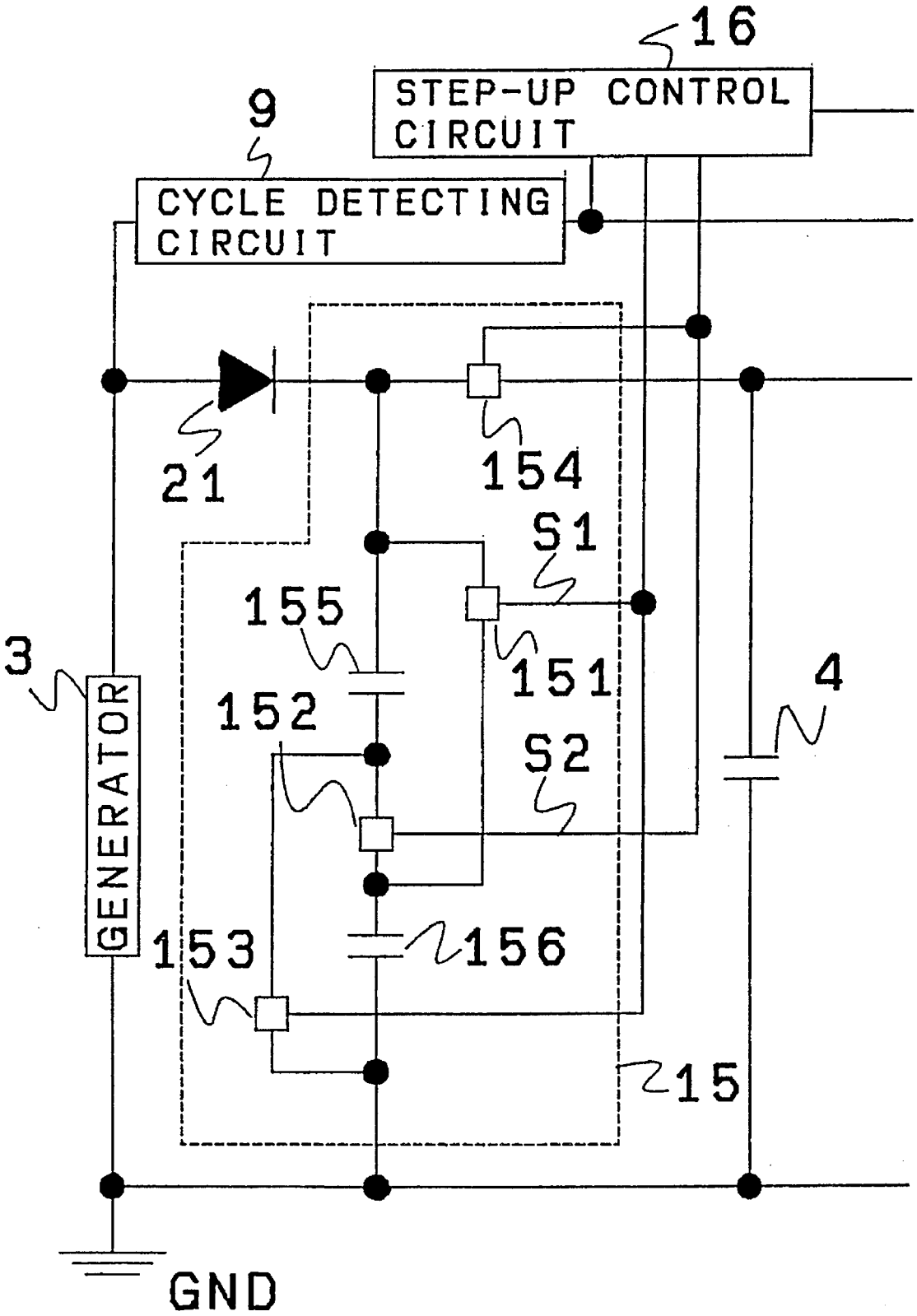
FIG. 15 is a circuit block diagram showing a step-up circuit in the second embodiment of the present invention.

The following description relates to the circuit structure in the second embodiment and refers to FIG. 15. FIG. 15 is a circuit block diagram showing a step-up circuit 15, a generator 3, a smoothing capacitor 4, a cycle detecting circuit 9 and a step-up control circuit 16, which together allow double step-up. The step-up circuit 15 is provided with switching elements 151, 152, 153 and 154 and step-up capacitors 155 and 156. ON/OFF switching of the switching elements 151, 152, 153 and 154 are controlled by step-up control signals S1 and S2 from the step-up control circuit 16. When the step-up control signals S1 and S2 are H, the switches are switched ON, and are switched OFF when the step-up control signals are L.

The step-up control circuit 16 is connected to the IC 11 and the cycle detecting circuit 9, generates a step-up control signal based on a cycle correction signal and a detected cycle signal and outputs it to the step-up circuit 15.

As for the basic operation of the circuit shown in FIG. 15, it is similar to that in the first embodiment described with reference to FIG. 9. Also, by using three or more step-up capacitors, triple or more boosting is possible in the same basic operation as above.

Figure 16:
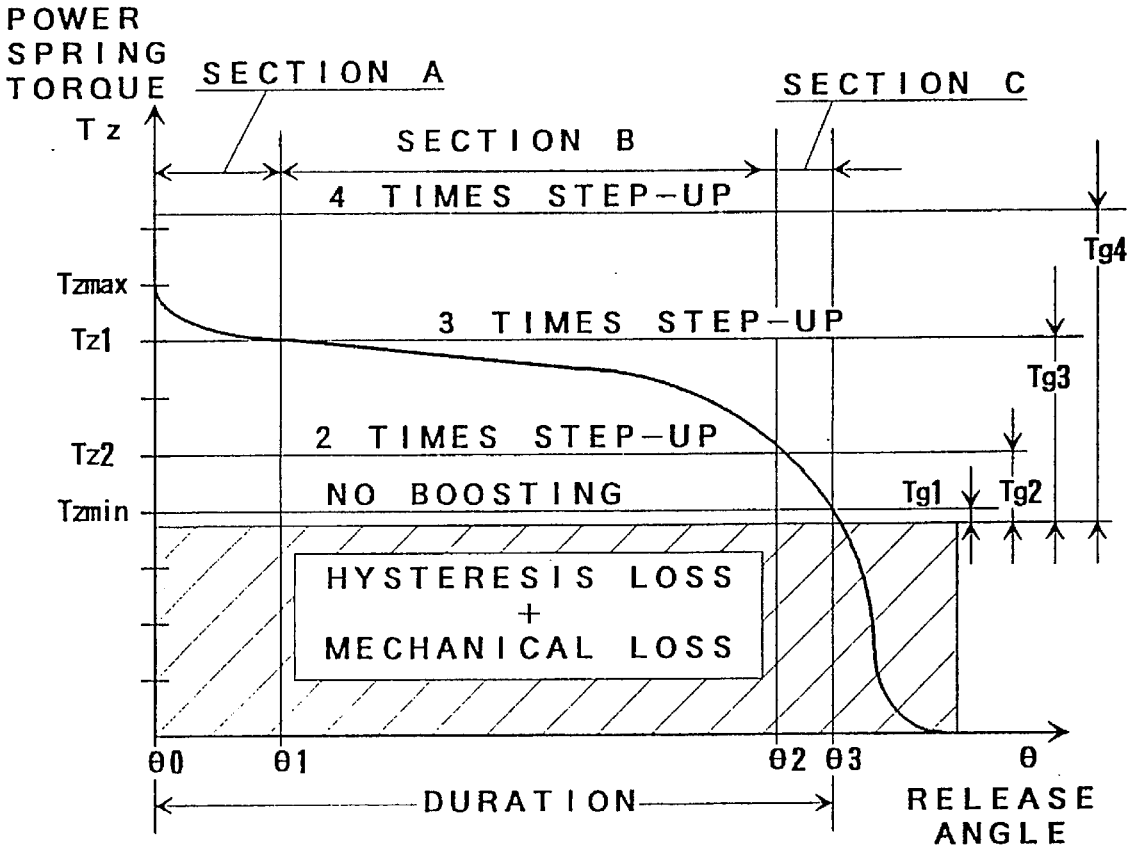
FIG. 16 is a view showing a relationship between the release angle of a power spring and a step-up multiplication ratio in the second embodiment of the present invention.

The following relates to the boosting timing of the step-up circuit 15 in the second embodiment and refers to FIG. 16. In FIG. 16, the abscissa indicates the release angle of a power spring corresponding to duration time while the ordinate indicates power spring torque Tz.

The state where the power spring is wound to its limit is a release angle θ0 and power spring torque at this time is Tzmax. Power spring torque is Tz1 when the power spring release angle changes from θ to θ1 (section A). Power spring torque is Tz2 when the power spring release angle changes from θ1 to θ2 (section B). Power spring torque is Tzmin when the power spring release angle changes from θ1 to θ3 (section C).

On the other hand, in the case where the generator rotates a predetermined number of times, by a step-up operation electrical loss torque Tg is Tg1 at the time of no step-up (one time step-up), tg2 at the time of double step-up(two times step-up), Tg3 at the time of triple step-up (three times step-up) and Tg4 at the time of quadruple step-up (four times step-up). Power spring torques Tz1, Tz2 and Tzmin and torque loss equivalent to electrically consumed torque Tg3, Tg2 and Tg 1 must be balanced.

Based on such a relationship, a sum total between power spring torque Tz and loss torque, i.e. (electrically consumed torque Tg+magnetic loss torque+mechanical loss torque), is balanced and thereby the rotation of the generator is kept at a predetermined number. This operation is described in detail in the following.

In the relationship between the release angle of the power spring and power spring torque, since Tz is between Tg4 and Tg3 in the section A, the number of rotations of the generator can be kept constant by alternately changing quadruple and triple step-ups. Also, since Tz is between Tg3 and Tg2 in the section B, the number of rotations of the generator can be kept constant by alternately changing triple and double step-ups. Since Tz is between Tg2 and Tg1 in the section C, the number of rotations of the generator can be kept constant by alternately changing double and single (no step-up) step-ups.

If the release angle of the power spring exceeds θ3, it is impossible to secure power spring torque necessary for keeping the rotation of the generator at a predetermined number. This is because the relationship "torque always consumed at a predetermined number of rotations>power spring torque Tzmin" is realized and rotation is delayed in order to maintain torque balance. Thus, the period of time expended to reach the release angle θ3 of the power spring becomes the duration time of the electronic control timepiece of the present invention. Further, since the respective losses of torque mentioned above are calculated in terms of torque applied to the power spring section, they are values added with corrections equivalent to a speed increasing ratio.

In the construction in the second embodiment described above, since it is possible to control the number of rotations of the generator by changing power consumed by the IC and appropriately switching step-up multiplication ratios, it is not necessary to use a special load control circuit. Further, since it is possible to substantially lengthen the duration time without extending the spaces occupied by the generator 3 and the power spring, a compact and thin electronic control timepiece having a long duration time can be obtained.

Embodiment 3

Figure 17:
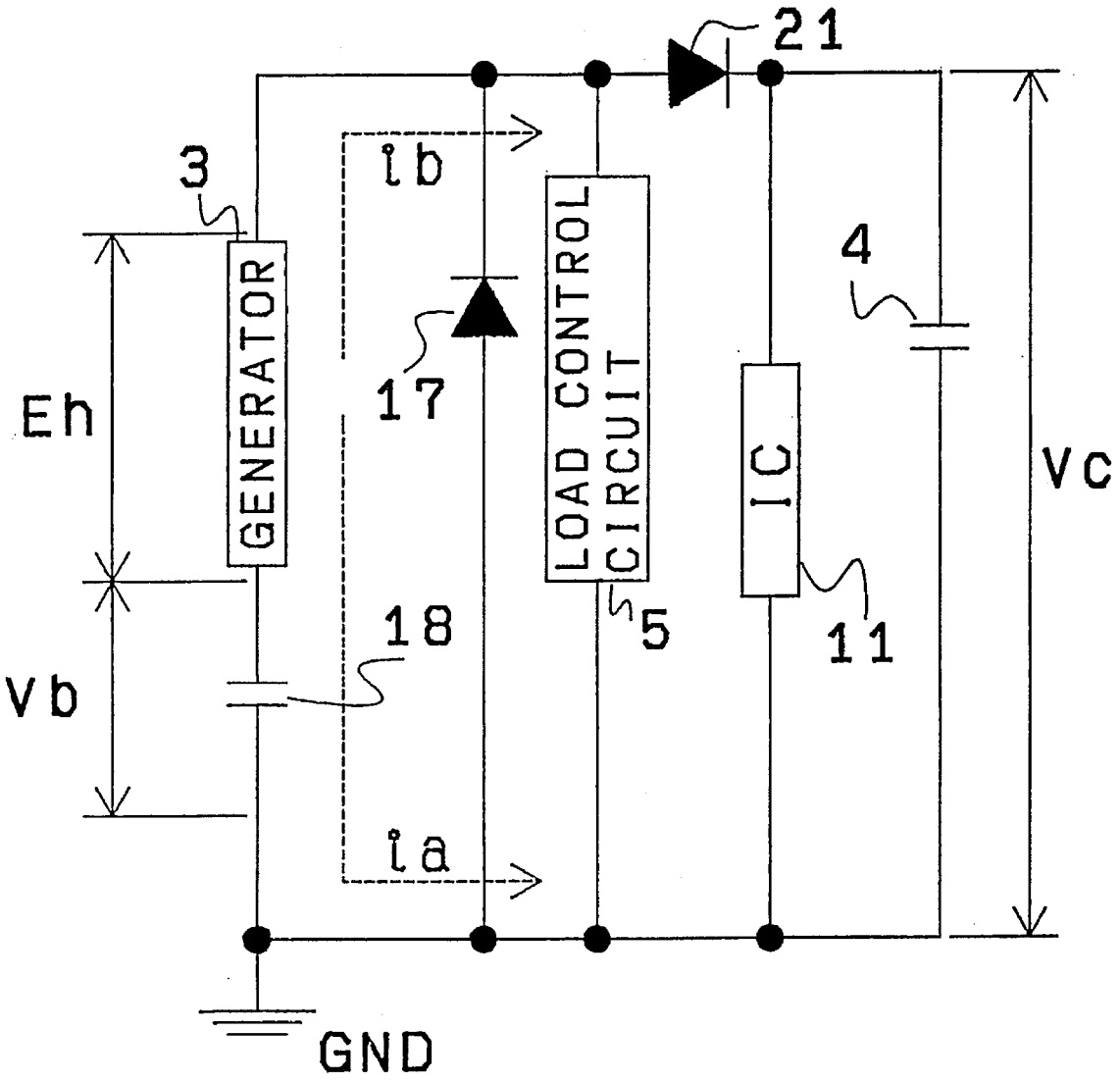
FIG. 17 is a circuit block diagram showing a step-up circuit using a sub-capacitor in the third embodiment of the present invention.
Figure 18:
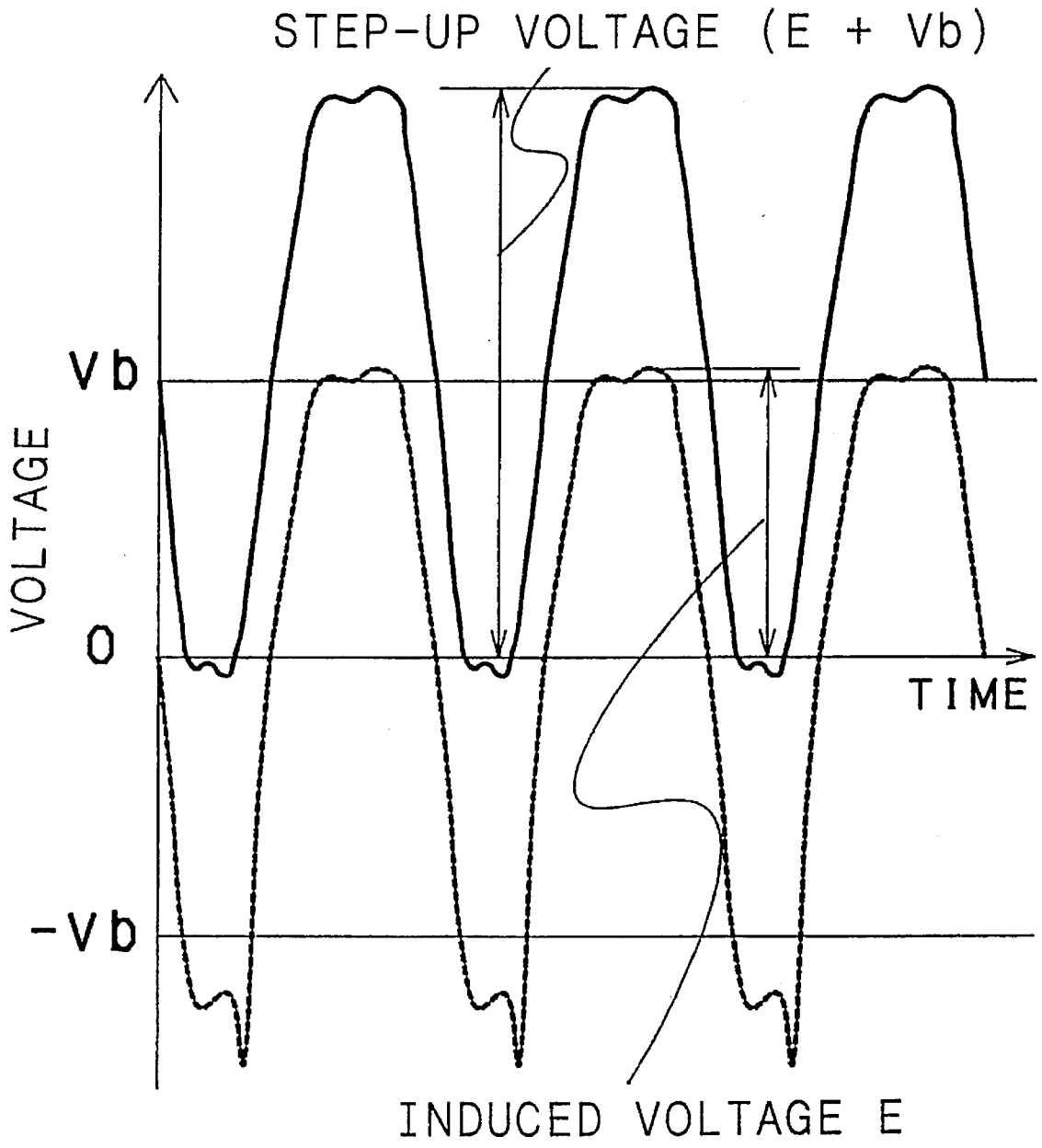
FIG. 18 is a graph showing a stepped-up voltage waveform in the third embodiment of the present invention.

The following description relates to a third embodiment of the present invention and refers to FIGS. 17 and 18.

The structure according to the present embodiment is made such that the step-up operation of an induced voltage in the generator can be executed independently of the operation of the IC.

A step-up circuit shown in FIG. 17 includes a sub-capacitor 18 and a diode 17. The sub-capacitor 18 is arranged in series with a generator 3. An electrically closed loop is formed by the generator 3, the sub-capacitor 18 and the diode 17. The cathode terminal of the diode 17 is connected to the anode terminal of a diode 21 and one terminal of the generator 3. The anode terminal of the diode 17 is connected to one terminal of the sub-capacitor 18.

The step-up principle of the step-up circuit is described in the following.

An AC electromotive force is generated in the generator 3. Its current flows in an ia or ib direction. The current ia is made to flow when it exceeds a potential Vb stored in the sub-capacitor 18 and an electric charge is stored therein, increasing the potential thereof. At this time, the current is made to flow to the electrically closed loop formed by the generator 3, the sub-capacitor 18 and the diode 17.

On the other hand, when a voltage obtained by adding the induced voltage E of the generator and the voltage Vb of the sub-capacitor 18 exceeds the potential of the smoothing capacitor 4, the current ib is made to flow. However, when an electrically closed loop to the load control circuit 5 is formed, the current ib flows unconditionally. The current ib flows into the smoothing capacitor 4 through the load control circuit 5 or the diode 21. Then, the voltage Vc of the smoothing capacitor 4 increases up to a level where it is equal to the sum of the induced voltage E and the voltage Vb of the sub-capacitor 18 i.e. (E+Vb).

FIG. 18 shows a waveform obtained by boosting the induced voltage E of the generator 3 by a voltage Vb held in the sub-capacitor 18. A solid line in FIG. 18 indicates a voltage obtained as a result of boosting (E+Vb), while a broken line indicates the result of measuring the induced voltage E of the generator.

It is not necessary to specify the capacitance of the sub-capacitor if it is lower than that of the smoothing capacitor.

As described above, in the step-up circuit according to the third embodiment, utilizing the fact that an induced voltage induced by the generator has an alternate characteristic irrespective of the existence of the electrical operation of the IC 11, it is possible to boost the potential of power charged to the smoothing capacitor. Thus, an advantage such as when the induced voltage of the generator is increased can be obtained. In this way, the number of rotations of the generator can be reduced and thereby a compact and thin electronic control timepiece having a long duration time can be provided.

Embodiment 4

Figure 19:
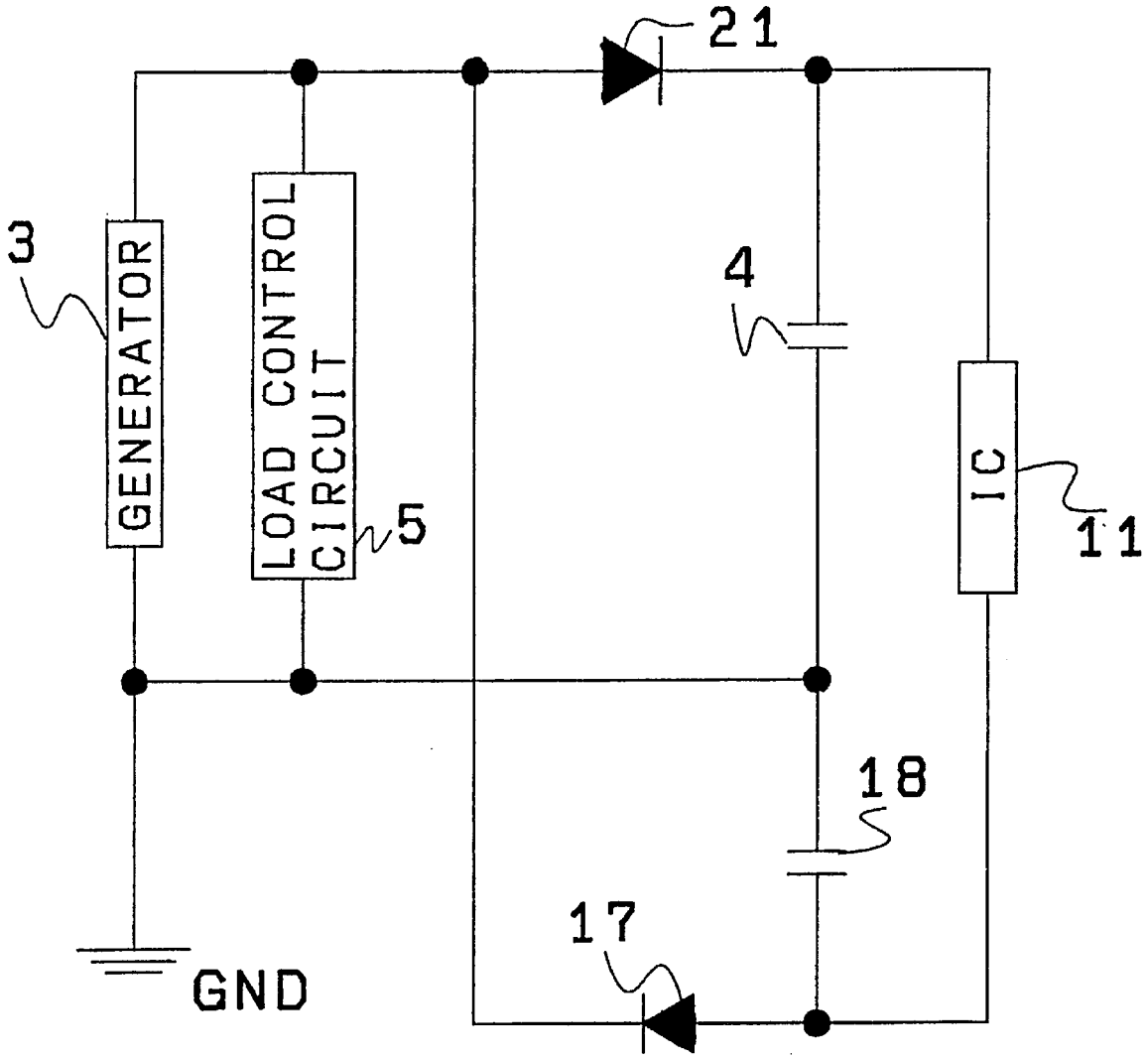
FIG. 19 is a circuit block diagram showing a step-up circuit using a sub-capacitor in the fourth embodiment of the present invention.

The fourth embodiment of the present invention is shown in FIG. 19. The fourth embodiment is related to another structure for carrying out a step-up operation of the induced voltage of the generator independently of the operation of the IC. As shown in FIG. 19, which is a circuit block diagram, a smoothing capacitor 4 and a sub-capacitor 18 are arranged in series with respect to an IC 11. The basic operation of this step-up capacitor is the same as that in the third embodiment and the advantage obtained is also the same as that in the third embodiment.

Embodiment 5

Figure 20:
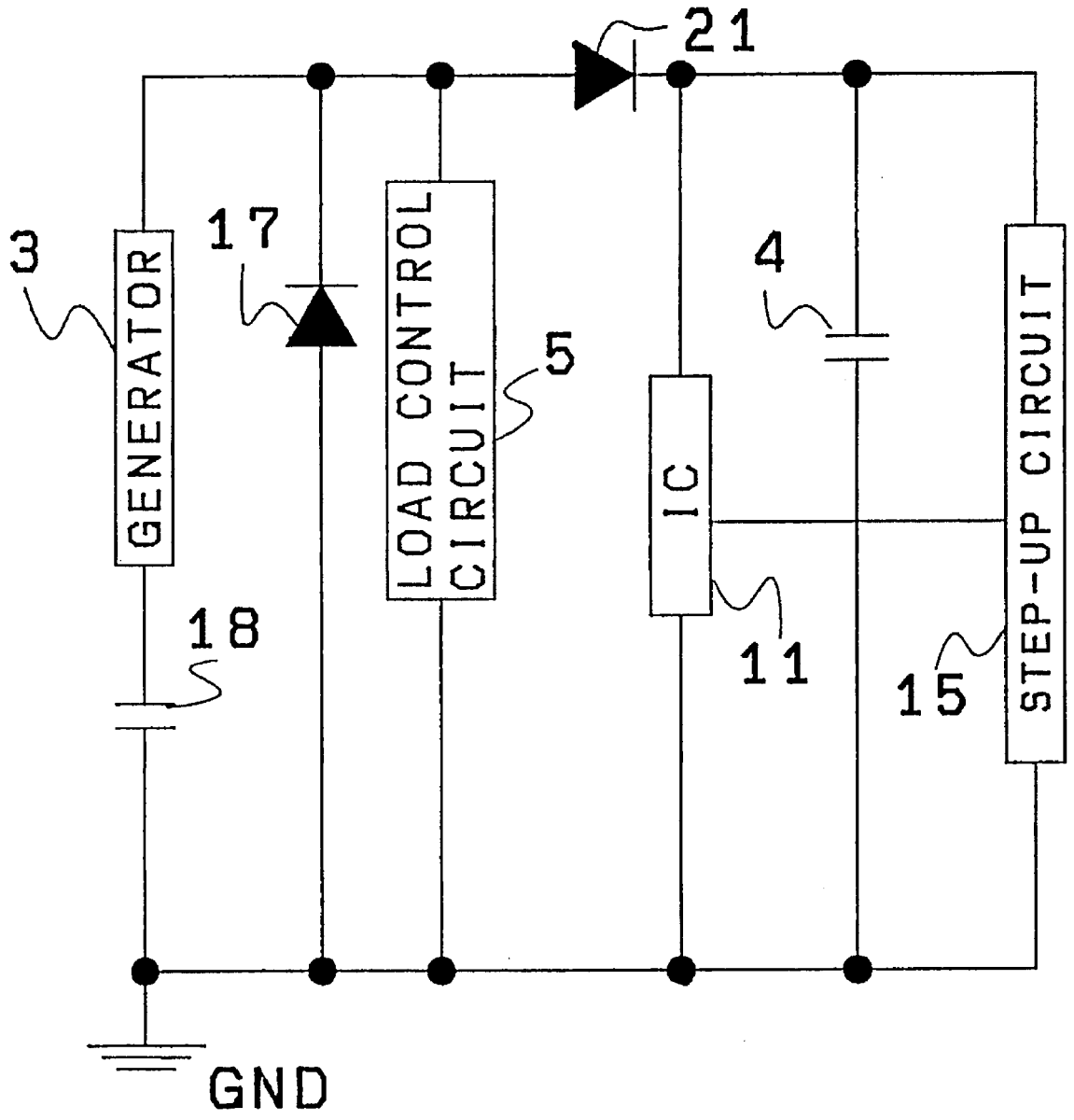
FIG. 20 is a circuit block diagram showing a step-up circuit in the fifth embodiment of the present invention.

The fifth embodiment of the present invention is shown in FIG. 20. As shown in FIG. 20, in the fifth embodiment the step-up multiplication ratio is further increased by combining a step-up circuit 15 for carrying out boosting electrically and a step-up circuit by a sub-capacitor 18 operated independently of the operation of the IC. The basic step-up operation of the fifth embodiment is the same as in the first and third embodiments. Thus, the advantage obtained is that obtained by combining the advantages of those in the first and third embodiments.

Embodiment 6

Figure 21:
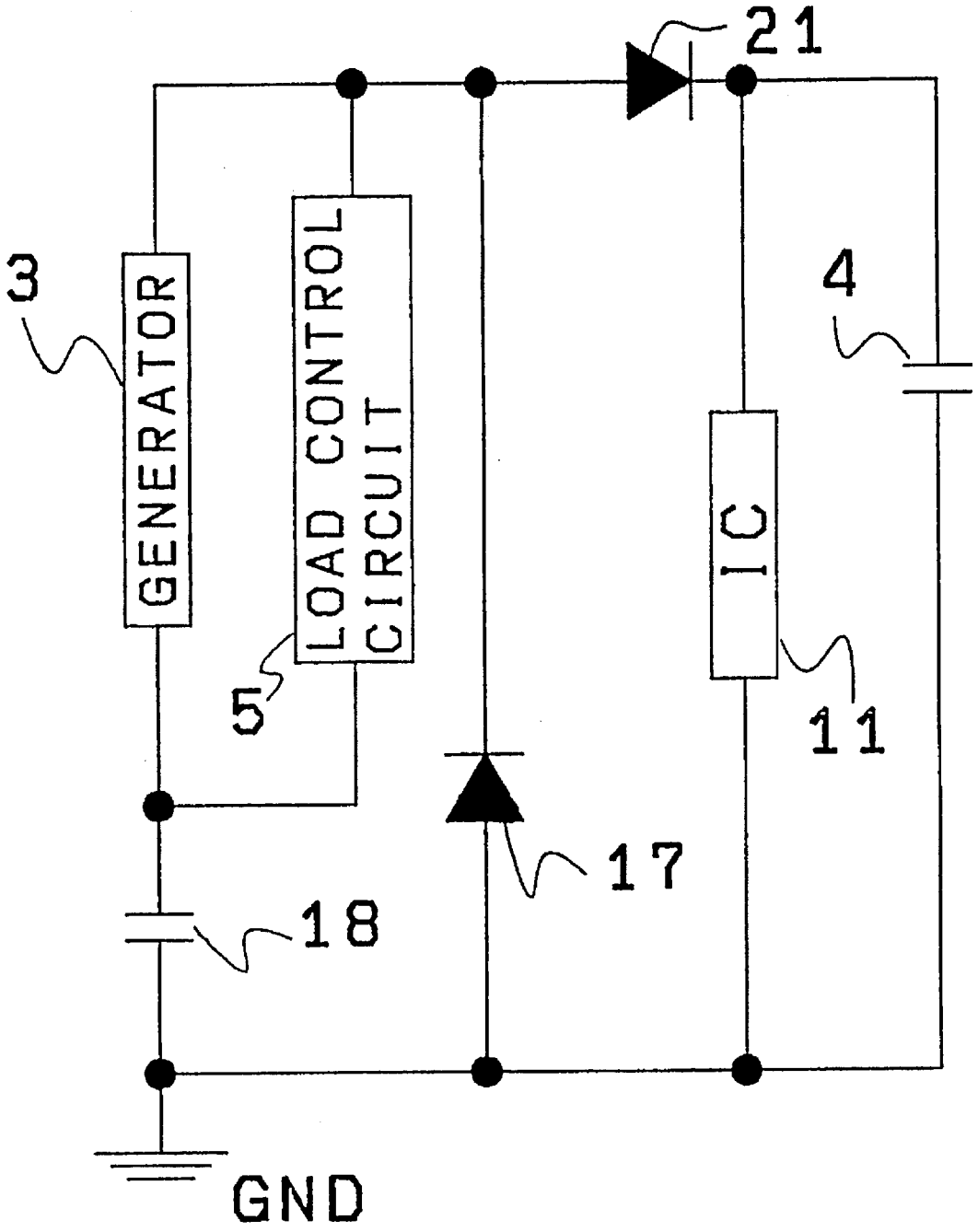
FIG. 21 is a circuit block diagram showing a step-up circuit in the sixth embodiment of the present invention.

The sixth embodiment of the present invention is shown in FIG. 21. In the sixth embodiment, it is possible to secure brake torque necessary for governing the speed of the rotation cycle of the generator without losing power supplied from a step-up circuit to a smoothing capacitor. As shown in FIG. 21, a load control circuit 5 and a generator 3 are arranged in parallel with respect to a sub-capacitor 18. The basic operation of this step-up circuit is the same as that in the third embodiment. Since it is possible to obtain the same advantage as that in the third embodiment, prevent consumption of storage power stored in the sub-capacitor 18 by the load control circuit 5, and maintain the voltage of the sub-capacitor independently of the operation of the load control circuit 5, a step-up voltage can be maintained more stably.

Embodiment 7

Figure 22:
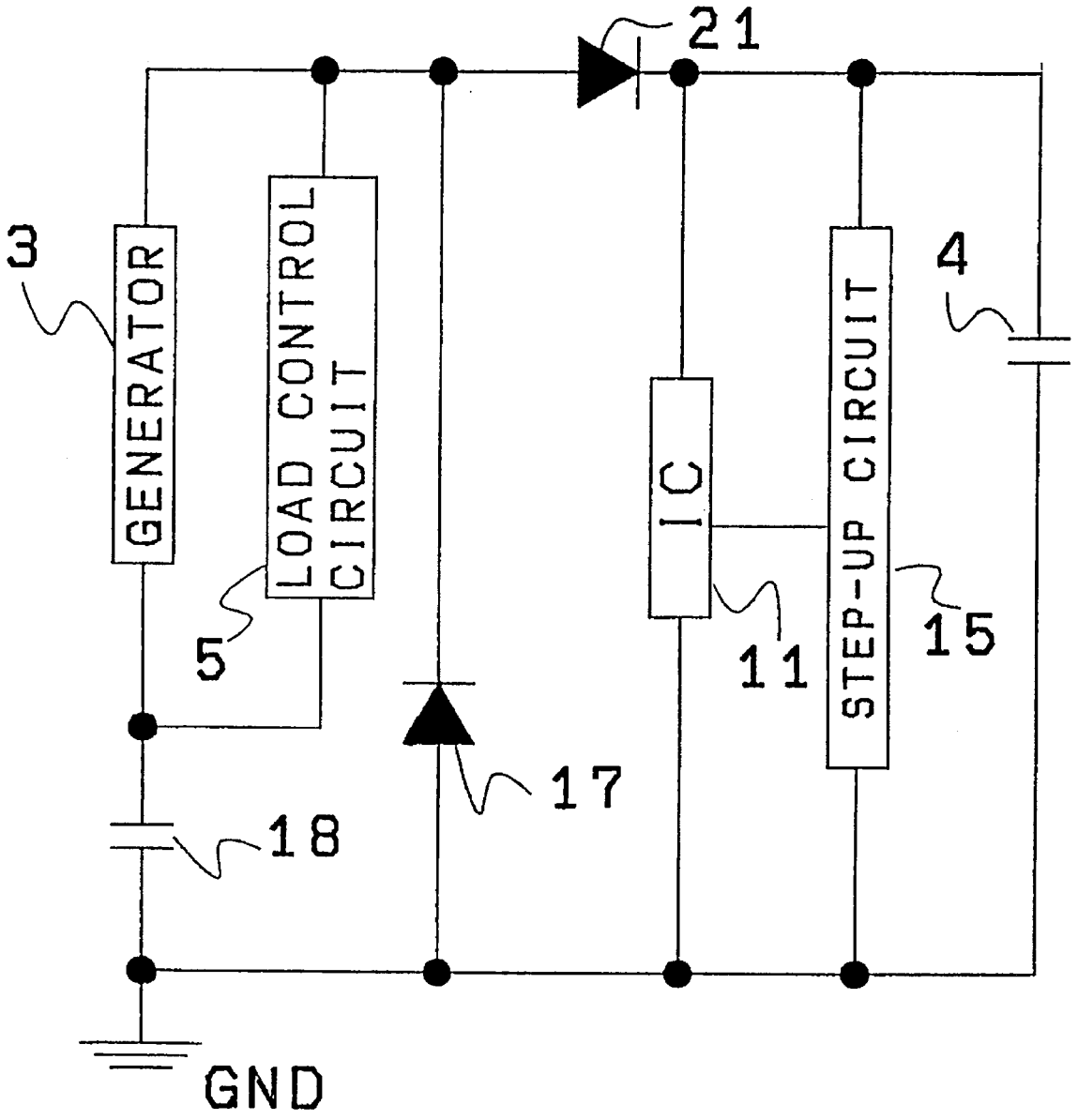
FIG. 22 is a circuit block diagram showing a step-up circuit in the seventh embodiment of the present invention.

The seventh embodiment of the present invention is shown in FIG. 22. As shown in FIG. 22, in the seventh embodiment it is possible to further increase a step-up multiplication ratio by combining a step-up circuit 15 for carrying out boosting electrically as shown in the first embodiment and a step-up circuit by a sub-capacitor 18 as shown in the sixth embodiment. The basic operation of the step-up circuit in the seventh embodiment is the same as those in the first and sixth embodiments. Thus, the advantage obtained is that obtained by combining the advantages of the first and sixth embodiments.

Embodiment 8

Figure 23:
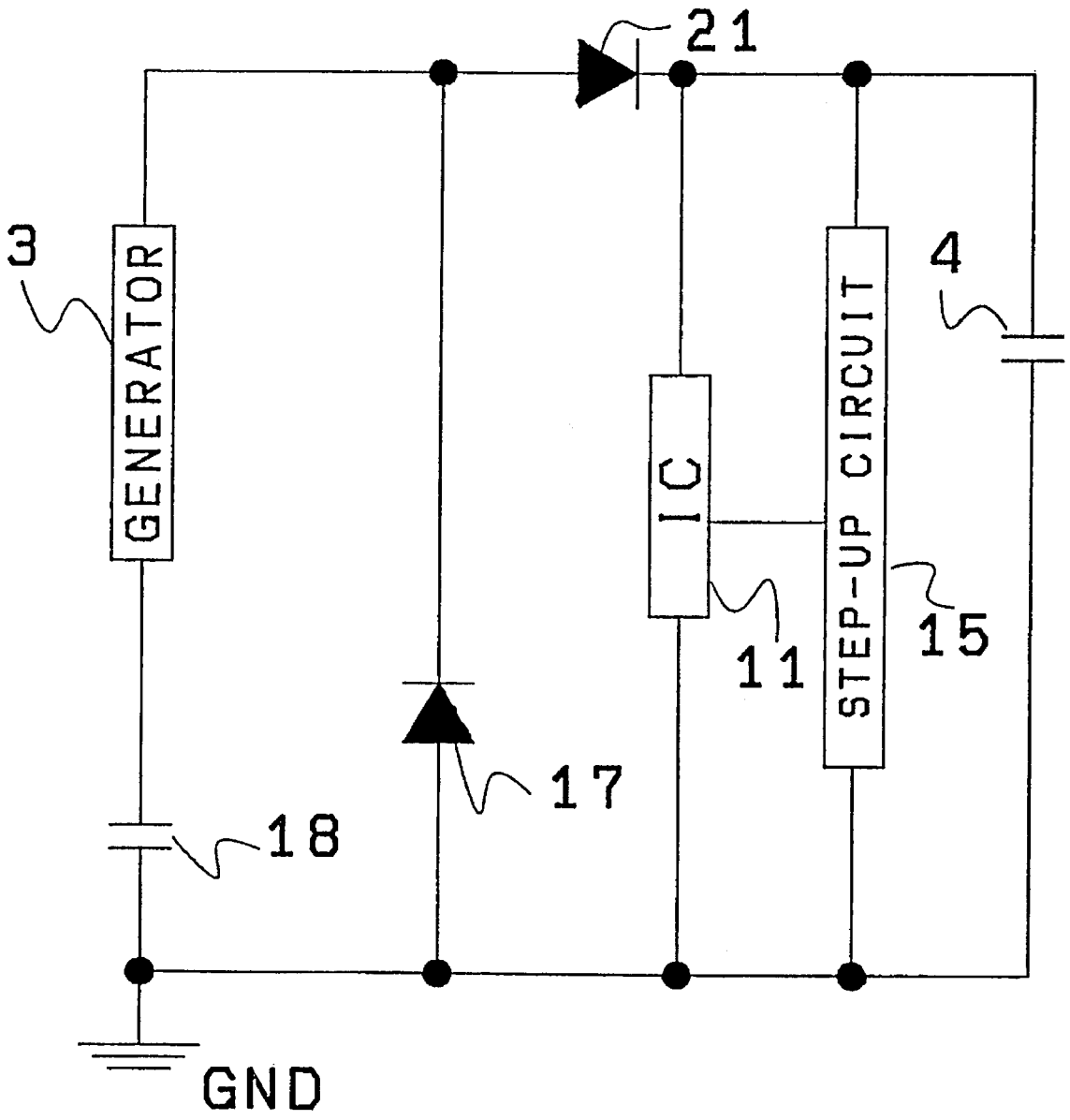
FIG. 23 is a circuit block diagram showing a step-up circuit in the eighth embodiment of the present invention.

The eighth embodiment of the present invention is shown in FIG. 23. As shown in FIG. 23, in the present embodiment, by combining the structure where the speed of the generator 3 is governed by the step-up circuit 15 for electrically carrying out boosting shown in the second embodiment and the step-up circuit by the sub-capacitor 18 shown in the third embodiment, the step-up multiplication ratio is further increased. The basic step-up operation and the speed governing operation in the eighth embodiment are the same as those in the second and third embodiments. Thus, the advantage obtained is that obtained by combining the advantages of the second and third embodiments.

Embodiment 9

Figure 24:
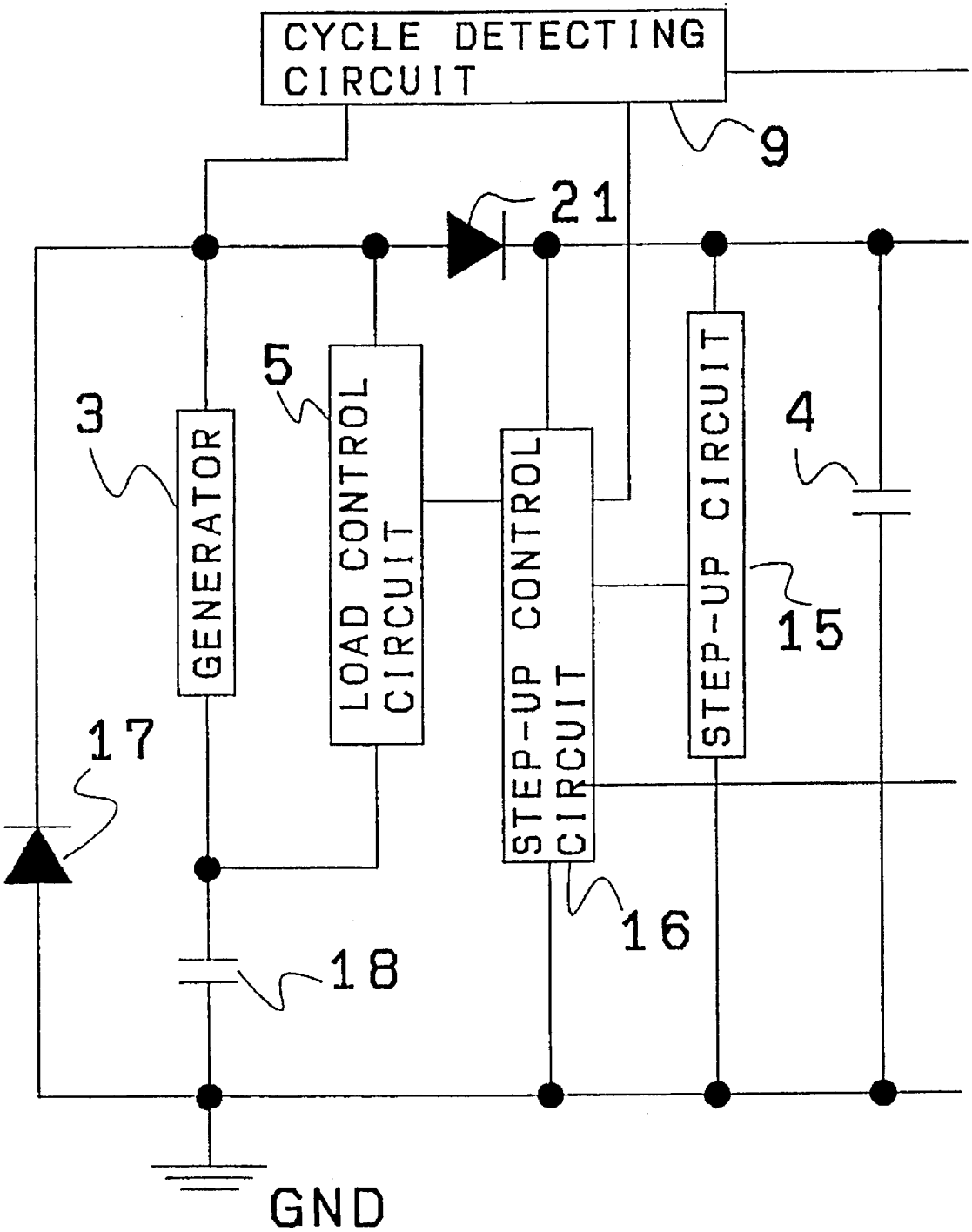
FIG. 24 is a circuit block diagram showing a step-up circuit in the ninth embodiment of the present invention.

The ninth embodiment of the present invention is shown in FIG. 24. In the present embodiment, by combining the construction where the speed of the generator 3 is governed by the step-up circuit 15 for electrically performing boosting shown in the second embodiment and the step-up circuit by the sub-capacitor 18 shown in the sixth embodiment a step-up multiplication ratio is further increased. In FIG. 24 a load control circuit 5 is arranged in parallel with a generator 3 and normally, as in the case of the second embodiment, the speed of the rotation cycle of the generator is governed by the step-up circuit 15. On the other hand, when external energy differing from normal condition is applied to the timepiece and the rotation cycle of the generator is shortened, control of the number of rotations of the generator is executed by the load control circuit 5.

To be more specific, in the operation of the load control circuit 5, when the timepiece is subjected to such factors as external magnetic fields, impacts and so on, causing the rotation cycle of the generator to be shortened, the rotation of the generator is accelerated. When this occurs, a cycle detecting circuit 9 detects the acceleration of the generator and outputs its detected cycle signal to a step-up control circuit 16. The step-up control circuit 16 in turn outputs a signal for increasing a step-up multiplication ratio to the step-up circuit 15 based on the detected cycle signal. Then, in the case where the rotation cycle does not coincide with a predetermined cycle even when the step-up multiplication ratio reaches its upper limit, a signal is outputted from the step-up control circuit 16 to the load control circuit 5 and thereby operation thereof is started. As a result, a current flows to the load control circuit 5, an electromagnetic brake is applied to the generator, and the rotation cycle of the generator is made to coincide with the predetermined cycle.

As detailed above, in the case where external factors differing from normal condition are applied to the timepiece and the number of rotations cannot be maintained by controlling the step-up circuit, the load control circuit 5 executes control of the number of rotations, replacing the step-up circuit.

The basic step-up operation and speed governing operation in the present embodiment are the same as those in the second and third embodiments. Thus, the advantage obtained is that obtained by combining the advantages of the second and sixth embodiments.

According to the structure based on the preferred embodiments of the present invention described above, it is possible to store power of a potential sufficient to maintain the operation of the IC in the smoothing capacitor 4 even in a case where the induced voltage of the generator does not reach the operational voltage of the IC. Therefore, the characteristic of the generator 3 can be substantially improved without expanding its space. Also, in the case where the induced voltage of the generator 3 is sufficiently high, it is possible to reduce the number of rotations of the generator by using the step-up circuit. This means that duration time can be substantially lengthened without expanding the space for the power spring. Consequently, a compact and thin electronic control timepiece having a long duration time can be provided.

Further, since the number of rotations of the generator can be controlled by appropriately changing the step-up multiplication ratios and the amount of power consumed by the IC, it is not necessary to use a special load control circuit. Also, since duration time can be substantially lengthened without expanding the spaces required for the generator 3 and the power spring, a compact and thin electronic control timepiece can be provided.

Further, the step-up circuit including a sub-capacitor and a diode can be made to boost the potential of power charging to the smoothing capacitor irrespective of the existence of the electrical operation of the IC 11. Thus, the same advantage is obtained as when the induced voltage of the generator increases. Since the number of rotations of the generator can be reduced in this way, it is possible to provide a compact and thin electronic control timepiece having a long duration time.

As it is also possible to obtain dual combined advantages by appropriately combining two kinds of step-up circuits previously mentioned, a further compact and thin electronic control timepiece having a long duration time can be provided.

Further, according to the present invention, even in the case where the induced voltage of the generator 3 does not reach the operational voltage of the IC, a potential sufficient to maintain the operation of the IC by means of the step-up circuit can be ensured and thus it is possible to prevent failure to detect the number of rotations of the generator 3 and thereby to detect the number of rotations at any time. Consequently, the speed of rotation of the generator can be further accurately governed and thus chronological precision as a timepiece can be improved.

What is claimed is:

1. An electronic timepiece comprising:

a power spring for storing mechanical energy which powers a timepiece;

a speed increasing gear train for transmitting mechanical energy stored in said power spring while gradually releasing the mechanical energy;

a generator driven by said speed increasing gear train for generating AC induced power and converting mechanical energy into electric energy;

a step-up circuit for generating a step-up voltage by boosting the voltage of the induced power generated by said generator to a predetermined voltage level;

a smoothing capacitor charged by a step-up voltage generated by said step-up circuit for storing electric energy generated by said generator;

a quartz oscillation circuit driven by electric energy stored in said smoothing capacitor for outputting an oscillation signal having a predetermined frequency;

a frequency dividing circuit for dividing the frequency of the oscillation signal outputted from said quartz oscillation circuit and outputting a reference cycle signal having a predetermined cycle;

a cycle detecting circuit for outputting a detected cycle signal corresponding to the rotation cycle of said generator in response to the AC induced power generated by said generator;

a cycle comparing circuit for comparing a cycle of the reference cycle signal outputted from said frequency dividing circuit and a cycle of the detected cycle signal outputted from said cycle detecting circuit, and outputting a cycle correction signal corresponding to a difference between both signals;

a variable load circuit for changing an electrical load on said generator in response to the cycle correction signal outputted from said cycle comparing circuit by controlling electrical loss torque of said generator whereby the rotation cycle of said generator coincides with a predetermined cycle corresponding to the reference cycle signal; and movable time-indicating hands coupled with said speed increasing gear train for indicating time.

2. An electronic control timepiece according to claim 1; wherein said step-up circuit includes a plurality of capacitors and a plurality of switching elements, said plurality of switching elements being periodically switched so as to charge said plurality of capacitors with induced power generated by said generator by connecting said plurality of capacitors in parallel, and to discharge electricity to said smoothing capacitor by connecting said plurality of charged capacitors in series.

3. An electronic control timepiece according to claim 2; further comprising a step-up control circuit, said step-up control circuit outputting a step-up control signal responsive to and synchronized with the detected cycle signal outputted from said cycle detecting circuit, and wherein ON/OFF switching of said plurality of switching elements in said step-up circuit is controlled by the step-up control signal outputted from said step-up control circuit and a step-up operation is performed in synchronization with the detected cycle signal.

4. An electronic control timepiece according to claim 3; wherein said step-up control circuit includes means for controlling a step-up multiplication ratio of said step-up circuit, and wherein said step-up circuit includes said variable load circuit, said step-up control circuit outputs the step-up control signal responsive to and synchronized with the detected cycle signal outputted from said cycle detecting circuit, and changes the step-up multiplication ratio of said step-up circuit in response to the cycle correction signal outputted from said cycle comparing circuit whereby an electrical load on said generator is changed, and the rotation cycle of said generator coincide with a predetermined cycle corresponding to the reference cycle signal by controlling electrical loss torque for said generator.

5. An electronic control timepiece according to claim 1; wherein said step-up circuit comprises a sub-capacitor serially connected to said generator, a terminal voltage of said sub-capacitor being superimposed on the induced voltage of said generator independently of a cycle of the detected cycle signal outputted from said cycle detecting circuit to boost a charging voltage to said smoothing capacitor.

6. An electronic control timepiece according to claim 1; wherein said step-up circuit comprises a first step-up circuit including a plurality of capacitors and a plurality of switching elements, said plurality of switching elements being periodically switched so as to charge said plurality of capacitors with induced power generated by said generator by connecting said plurality of capacitors in parallel and discharging electricity to said smoothing capacitor by connecting said plurality of capacitors in series; and a second step-up circuit including a sub-capacitor serially connected to said generator, a terminal voltage of said sub-capacitor being superimposed on the induced voltage of said generator independently of a cycle of the detected cycle signal outputted from said cycle circuit to boost a charging voltage to a said smoothing capacitor.

7. An electronic control timepiece according to claim 1; wherein said variable load circuit includes a load control circuit having a switching element and a resistor, said switching element controlling a connection between said resistor and said generator in response to the cycle correction signal outputted from said cycle comparing circuit by periodically switching the connection ON/OFF to change a load on said generator.

8. An electronic control timepiece according to claim 1; wherein said step-up circuit operates as said variable load circuit to control the electrical loss torque for said generator by changing the step-up multiplication ratio of said step-up circuit whereby an electrical load on said generator is changed.

9. An electronic control timepiece according to claim 1; wherein the electrical loss torque of said generator is controlled by changing the step-up multiplication ratio of said step-up circuit and by periodically switching a connection between a resistor included in said load control circuit and said generator.

* * * * *